US006904261B2

(12) United States Patent
Fujii et al.

(10) Patent No.: US 6,904,261 B2
(45) Date of Patent: Jun. 7, 2005

(54) INSERT SHEET TRANSPORTING APPARATUS AN INSERT SHEET TRANSPORTING METHOD AND AN IMAGE FORMING APPARATUS

(75) Inventors: Takayuki Fujii, Tokyo (JP); Norifumi Miyake, Chiba (JP); Masaharu Nemura, Ibaraki (JP); Tsuyoshi Moriyama, Ibaraki (JP); Yuzoh Matsumoto, Ibaraki (JP); Yusuke Obuchi, Chiba (JP); Koji Shimizu, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/610,819

(22) Filed: Jul. 2, 2003

(65) Prior Publication Data

US 2004/0022564 A1 Feb. 5, 2004

(30) Foreign Application Priority Data

Jul. 8, 2002 (JP) ..... 2002-199265

(51) Int. Cl.[7] ..... G03G 15/00
(52) U.S. Cl. ..... 399/382; 399/16
(58) Field of Search ..... 399/16, 18, 20, 399/382, 407; 271/10.01, 10.02, 18

(56) References Cited

U.S. PATENT DOCUMENTS

| | | | | |
|---|---|---|---|---|
| 4,908,660 A | * | 3/1990 | Ohira et al. | 399/16 |
| 5,272,511 A | * | 12/1993 | Conrad et al. | 399/382 |
| 5,299,795 A | | 4/1994 | Miyake | 271/9 |
| 5,390,016 A | | 2/1995 | Hoshi et al. | |
| 5,452,062 A | * | 9/1995 | Baldwin et al. | 399/382 |
| 5,455,667 A | | 10/1995 | Hiroi et al. | |
| 5,535,012 A | | 7/1996 | Matsumoto et al. | 358/400 |
| 5,580,045 A | | 12/1996 | Matsumoto et al. | 271/298 |
| 6,219,503 B1 | | 4/2001 | Miyake et al. | 399/85 |
| 6,246,491 B1 | | 6/2001 | Matsumoto et al. | 358/468 |
| 6,330,422 B1 | | 12/2001 | Sato et al. | 399/382 |
| 6,351,625 B1 | * | 2/2002 | Sato et al. | 399/382 |
| 6,588,740 B2 | * | 7/2003 | Brugger et al. | 271/10.01 X |
| 6,636,703 B2 | * | 10/2003 | Deen et al. | 399/18 X |
| 2002/0190456 A1 | | 12/2002 | Miyake et al. | 270/58.08 |
| 2003/0044186 A1 | | 3/2003 | Kato et al. | 399/16 |

FOREIGN PATENT DOCUMENTS

| | | |
|---|---|---|
| JP | 60-180894 | 9/1985 |
| JP | 60-191932 | 9/1985 |
| JP | 60-204564 | 10/1985 |

* cited by examiner

*Primary Examiner*—Sandra L. Brase
(74) *Attorney, Agent, or Firm*—Fitzpatrick, Cella, Harper & Scinto

(57) ABSTRACT

The proposed apparatus is designed for being capable of recovering even when the overlapped transport of insert sheets has occurred without stopping the apparatus, thereby providing an improved utility to the users. The apparatus includes a first sheet feeder for sequentially separating blank sheets into individual sheet, an image forming device for forming images on the blank sheets, a transport device for waiting the blank sheet to be supplied to the image forming apparatus at predetermined time, a second sheet feeder for sequentially separating the insert sheets into individual sheet, an overlapped transport detecting device for determining whether or not the insert sheets have been transported in overlapped condition, and a controller for discharging all the insert sheets of a set involved in the overlapped transport onto a predetermined place, finding the first insert sheet of a next set of insert sheets, and discontinuing the drive of the transport device.

7 Claims, 24 Drawing Sheets

INSERT SHEET TRANSPORTING APPARATUS AN INSERT SHEET TRANSPORTING METHOD AND AN IMAGE FORMING APPARATUS

This application claims priority from Japanese Patent Application No. 2002-199265 filed Jul. 8, 2002, which is incorporated hereinto by reference.

BACKGROUND OF THE INVENTION

1. Field of the Invention

The present invention relates to a system for forming images on the sheets and outputting the sheet whereon the images are formed, more particularly, to an insert sheet transporting apparatus, an insert sheet transporting method and an image forming apparatus for transporting, loading the sheets from a plurality of sheet feeding stages and preparing the bundles of the sheets that the sheets supplied from a plurality of sheet feeding stages are mixed.

2. Description of the Related Art

The conventional image forming apparatus, such as the copying machine, is designed for being capable of operating in the modes such as the cover placing mode, the insert sheet mode of the like. These modes are designed and controlled for permitting the sheets supplied from the cassette or the sheet feeding tray provided with the image forming apparatus to be placed on the first page and after the last page or inserted between pages. Therefore, even the sheets supplied from sheet feeding stage other than that of the present bundle of the sheets can be added as "a front cover" or "a back cover" or inserted as "an insert sheet". Further, in the similar fashion, the sheet supplied from a special tray for loading "the insert sheets" can also be inserted. In such a system, the insert sheet is required to undergo a mere transport process, so that the order of insertion (place of insertion), the number of sheet to be inserted can be set freely. Thus, the bundle of the sheets including the inserted sheets can undergo the post-processing such as the processing as a bundle of the sheets, i.e., the discharge in the form of a bundle, processing for binding, processing for folding, processing for book-binding by the finisher or the like, which is provided with the main unit of the image forming apparatus.

Hereinafter, the operation modes, which insert the sheets supplied from the insert sheet stage as the "front cover", "insert sheet" and "back cover", are generally called "the insert sheet mode."

In the method for supplying the insert sheet from the cassette, when the timing for the insertion of the sheet comes, the insert sheet is fed into the transport pass of the sheet whereon the image is to be formed, and the fed insert sheet is discharged by way of the transport pass. In this system, a fixing stage is provided on the course of the previously mentioned transport path, and the insert sheet passes the fixing stage similarly to the non-fixed sheet.

Where the original having the color image printed thereon is fed as the insert sheet, there happens sometimes that the quality of the printed image is damaged due to the effect of the heat and pressure while the insert sheet passes the fixing stage. Further, as the personal computers spread the use of the color images has also increased, thereby causing the increase in the use of the color copied papers/color printed papers as the insert sheets. When such color copied papers are supplied from the cassette, the transport efficiency of such color copy papers tends to fall due to the influence of the oil or the like deposited on the surfaces thereof, sometimes causing a marked fall of the reliability of the non-fixed sheet transport operation.

Further, there has been developed an apparatus comprising the finisher provided with the sheet feeder for supplying the insert sheets so that the insert sheets can be supplied from the finisher. As the examples of this type of apparatus, there are those published under Japanese Patent Application Laid-open Nos. 60-180894(1985), 60-191932(1985), 60-204564(1985) and the like. More particularly, in the cases of those apparatuses recited in said publications, the insert sheets are supplied to the finisher from the insert sheet feeder at predetermined time and transported to and stored in the intermediate tray of the finisher in the loaded state. The printed sheets discharged from the main unit of the image forming apparatus are also guided into the finisher and transported to the intermediate tray for being loaded thereon. In order to let the apparatus perform such an operation, it is necessary for the printed sheets to have supplied in the number required, arranged in the order corresponding to the contents of the images and loaded in advance on the storage device of the insert sheet feeder.

When selecting the sheet insert mode in combination with the insert sheet feeder, it is necessary for the insert sheets supplied from the insert sheet feeder to be fed individually and accurately into the finisher. In this stage, since the insert sheets are to be used in a variety of quality and for a variety of images, when the insert sheets undergo the automatic separation/transport stage, the stability in operation tend to differ from that in the case of the blank sheets for recording. For instance, it gives rise to a problem such that two insert sheets in overlapped condition are fed from the insert sheet feeder causing the so-called "overlapped transport", which put the sequence of the sheets in subsequent bundle out of order.

In a conventional image forming apparatus, the necessary number of sheets to be outputted is set by the operating section thereof, and the image forming operation is continued until coming to an end thereof; in such an apparatus, when the overlapped transport of the insert sheets has occurred, the insert sheets will be inserted at wrong places in all bundles of the sheets after the point at which the overlapped transport has occurred, thereby causing the disadvantages such as the wastes of paper, time, power and the like.

Further, in the case of a system designed for enabling to stop its operation once to permit the examination of what has happened during the operation up to the point where the supply of sheet bundle is discontinued, it is possible for the user to detect the occurrence of the overlapped transport, if any, earlier than in the case of the system wherein the detection is made without stopping all the operations of the system. However, in the case where a bundle consists of a large number of sheets, even if the user has visually detected the overlapped transport, the operation of the system will continue until the system is stopped, so that even such a system is disadvantageous for the user, since the waste supply of the sheets still occurs.

Thus, the object of the present invention lies in providing an apparatus capable of making the recovery of its normal state without discontinuing the operation of the system, even if the overlapped transport of the insert sheets has occurred, by properly controlling the image forming apparatus and the finisher, thereby improving the utility of the image forming apparatus for the users.

SUMMARY OF THE INVENTION

In order to attain the above-mentioned object, the insert sheet transporting apparatus according to the present invention is designed for being capable of supplying one set of insert sheets to at least one set of sheet bundle and inserting each of the set of insert sheets at predetermined places among the set of the sheet bundle. The insert sheet transporting apparatus comprises a sheet feeding device for loading a plurality of sets of insert sheets and sequentially separating the insert sheets into individual sheet to feed, an overlapped transport detecting device for determining whether or not the insert sheets, which have been fed from the sheet feeding device, have been transported in overlapped condition, and a controller for discharging all the insert sheets of the set involved in the overlapped transport onto a predetermined place and finding the first insert sheet of the next set of insert sheets when the overlapped transport is determined.

The image forming apparatus according to the present invention is designed for being capable of forming the images on the predetermined blank sheets, supplying one set of insert sheets to at least one set of sheet bundle that the image is formed thereon, and inserting each of the set of insert sheets at predetermined places among the set of blank sheet bundle. The image forming apparatus comprises a first sheet feeding device for sequentially separating the blank sheets for recording into individual sheet to feed, an image forming device for forming the images on the blank sheets for recording, a transport device for transporting the blank sheets for recording, which have been kept waiting after having been fed from the first sheet feeding device, to be supplied to the image forming device at a predetermined timing, a second sheet feeding device for loading a plurality of sets of insert sheets and sequentially separating the insert sheets into individual sheet to feed, an overlapped transport detecting device for determining whether or not the insert sheets fed from the second sheet feeding device have been transported in overlapped condition, and a controller for discharging all the insert sheets of the set involved in the overlapped transport onto a predetermined place and finding the first sheet of the next set of insert sheet when the overlapped transport is determined by the overlapped transport detecting device, simultaneously with discontinuing the drive of the transport device.

Further, when the transporting of the blank sheets for recording to the image forming apparatus had already started at the point where the overlapped transport of the insert sheets was determined by the overlapped transport detecting device, the controller discontinues the drive of the transport device after the transporting has been completed.

Further, when the overlapped transport of the insert sheets has been determined by the overlapped transport detecting device, the controller discharges all the insert sheets of the set involved in the overlapped transport and the blank sheets for recording on which the images have formed by the image forming apparatus onto predetermined place, resumes the drive of the transport device and starts forming the images from the first blank sheet of the set of blank sheet bundle.

The insert sheet transporting method according to the present invention is characterized in that one set of insert sheets is supplied to at least one set of blank sheet bundle, and each of the set of insert sheets are inserted at predetermined places among the set of the blank sheets. The insert sheet transporting method comprises a sheet feeding step for loading a plurality of sets of insert sheets and sequentially separating the insert sheets into individual sheet to feed, an overlapped transport detecting step for determining whether or not the insert sheets fed in the sheet feeding step have been transported in overlapped condition, and a control step for discharging all the insert sheets of the set involved in the overlapped transport onto predetermined place and finding the first insert sheet of next set of insert sheets when the overlapped transport of the insert sheets is determined in the overlapped transport detecting step.

The above and other objects, effects, features and advantages of the present invention will become more apparent from the following description of embodiments thereof taken in conjunction with the accompanying drawings.

BRIEF DESCRIPTION OF THE DRAWINGS

FIG. 22A is a schematic diagram illustrating the flow of the control signal between the main unit of the image forming apparatus and the finisher according to the present invention in the normal state, while

DETAILED DESCRIPTION OF PREFERRED EMBODIMENTS

The embodiments of the present invention will be described referring to the accompanying drawings.

(General Composition)

Figure 1:
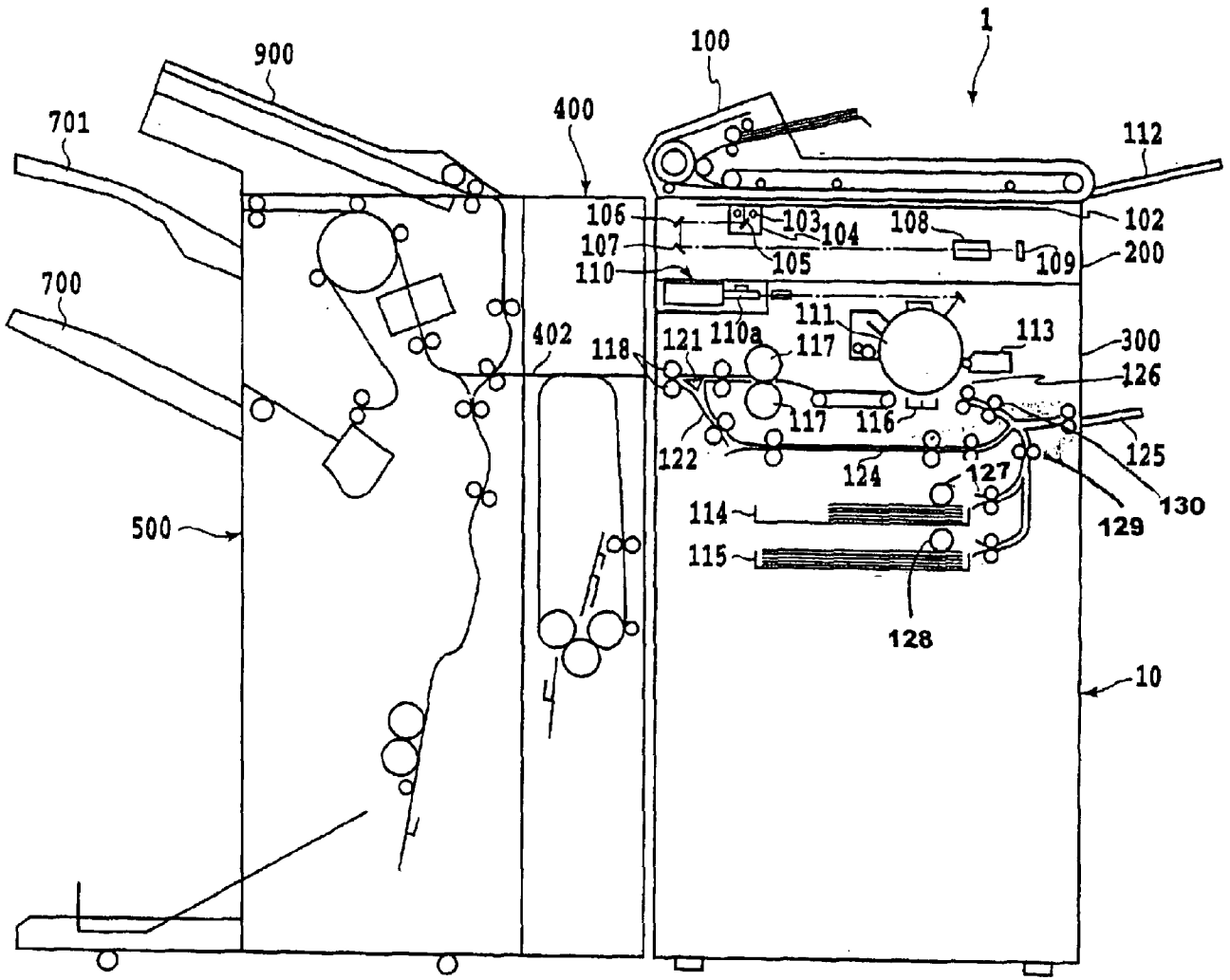
FIG. 1 is a schematic diagram illustrating the construction of the image forming apparatus according to the present invention.

FIG. 1 is a longitudinal sectional view showing the composition of the main part of the image forming apparatus as an embodiment of the present invention.

The image forming apparatus, as shown in FIG. 1, comprises a main unit 10 of the image forming apparatus, a folding device 400 and a finisher 500, while the main unit 10 of the image forming apparatus comprises an image reader 200 for reading the original image and a printer 300.

The image reader 200 is mounted with an original feeding device 100. The original feeding device 100, as a first sheet feeding device, lets the originals, which are loaded on a original sheet tray with their surfaces up, be fed leftward one by one from the first sheet and further be transported rightward by passing a curved path, a platen glass 102 and a scanning point from the left-hand side until being finally discharged into the external sheet discharging tray 112. When each of the originals passes through the moving original scanning point on the platen glass 102 from the left to the right, the image on the original is scanned by a scanner unit 104 located at the point corresponding to the moving original scanning point. This scanning method is generally called the moving original scanning method. More specifically, when the original passes through the moving original scanning point, the side of the original to be scanned is irradiated by the light from a lamp 103 of the scanner unit 104, and the light reflected by the original is guided to a lens 108 by way of mirrors 105, 106 and 107. The light passing the lens 108 is focused on the image pickup surface of the image sensor 109.

Thus, when the original is transported so as to pass through the moving original scanning point from the left to the right, the original can be scanned in the main scanning direction, which is orthogonal to the transport direction of the original, and in the sub-scanning direction, which is in the transport direction of the original. In other words, when the original passes through the moving original scanning point, each line of the image on the original is scanned in the main scanning direction by the image sensor 109, while the original is transported in the sub-scanning direction to complete the scanning of the whole image of the original. The optically picked up image is converted into the image data by means of the image sensor 109 in order to be outputted. The image data outputted from the image sensor 109 undergoes the predetermined processing by a controller 202 for image signal processing, which will be described later, to be inputted, as a video signal, to an exposure controller 110 of a printer 300.

Further, it is also possible that the original is transported to a predetermined stop position on the platen glass 102 where scanner unit 104 is made to scan from the left to the right to scan the original. This method is so-called standing original scanning method.

When reading the original without using the original feeding device 100, first the user is required to put up the original feeding device 100 to place the original onto the platen glass 102 and to let the scanner unit 104 scan the original from the left to the right to scan the original. In other words, the standing original scanning method is employed when scanning the original without using the original feeding device 100.

The exposure controller 110 of the printer 300 modulates the laser beam to be outputted according to the inputted video signal, and the laser beam is irradiated on a photosensitive drum 111 while being scanned by a polygon mirror 110*a*. The electrostatic latent image is formed on the photosensitive drum 111 corresponding to the scanning laser beam. In this case, as described later, when scanning the standing original, the exposure controller 110 outputs the laser beam so that an authentic image (not a reflected image) is formed.

The electrostatic latent image on the photosensitive drum 111 is turned into the visible image formed by the developer supplied from a processor 113. On the other hand, the blank sheets supplied from an upper cassette 114 or a lower cassette 115 by means of pickup rollers 127 and 128 are transported to a resist roller 126 by means of the sheet feeding rollers 129 and 130. When the front end of the blank sheet has reached the resist roller 126, the resist roller 126 is driven at any timing to transport the blank sheet between the photosensitive drum 111 and a transcriber 116 so that the image formed on the photosensitive drum 111 by means of the developer is transcribed onto the blank sheet supplied from the transcriber 116.

The sheet, whereon the image developed by the developer is transcribed, is transported to a fixing device 117, where the transported sheet is pressed while being heated to fix the image formed on the surface of the sheet. The sheet that has passed the fixing device 117 is discharged to outside (the folding device 400) by way of a flapper 121 and a discharging roller 118.

Then, when the sheet with its surface whereon the images are formed is discharged in face-down state from the main unit, the sheet, which has passed the fixing device 117, is once guided into a reversing path 122 by means of the switching action of the flapper 121, and, when the rear end of the sheet has passed the flapper 121, the sheet is switched back to be discharged from a printer 300 by means of a discharging roller 118. Hereinafter, this paper discharge mode is called the reverse paper discharge mode. This reverse sheet discharge mode is applied in a situation such that where the images scanned by the original feeding device 100 or the images outputted from the computer need to be formed sequentially from the first page. When this reverse sheet discharge mode is applied, the discharged sheets are arranged in normal order.

Further, when a hard sheet such as an OHP sheet is fed from the manual sheet feeding device 125 for forming the images thereon, such a sheet is not guided to a reversing pass 122 and discharged, with the surface on which the image is formed set face-up state, by means of the discharging roller 118.

When the bifacial recording mode for forming the image on both the face and the back of a sheet is set, the sheet is guided to the reversing pass 122 by means of the switching action of the flapper 121 and then to a bifacial transport path 124, where the guided sheet is re-fed between the photosensitive drum 111 and the transcribing device 116 synchronously with the previously described timing.

The sheet discharged from the printer 300 is transported to the folding device 400. This folding device 400 is designed for folding the sheet in zigzag. For instance, when the sheets of the A3 size or B4 size are to be used, and the setting for folding operation has been made, the folding operation is made by the folding device 400. When other operation mode is set, the sheet discharged from the printer 300 is transported to a finisher 500 passing through the folding device 400. The finisher 500 is provided with an inserter 900, which is designed for feeding the special sheets to be used for the cover or the insert sheets or the like. The finisher 500 performs the functions such as the bookbinding, binding, perforating or the like.

(Block Diagram of System)

Figure 2:
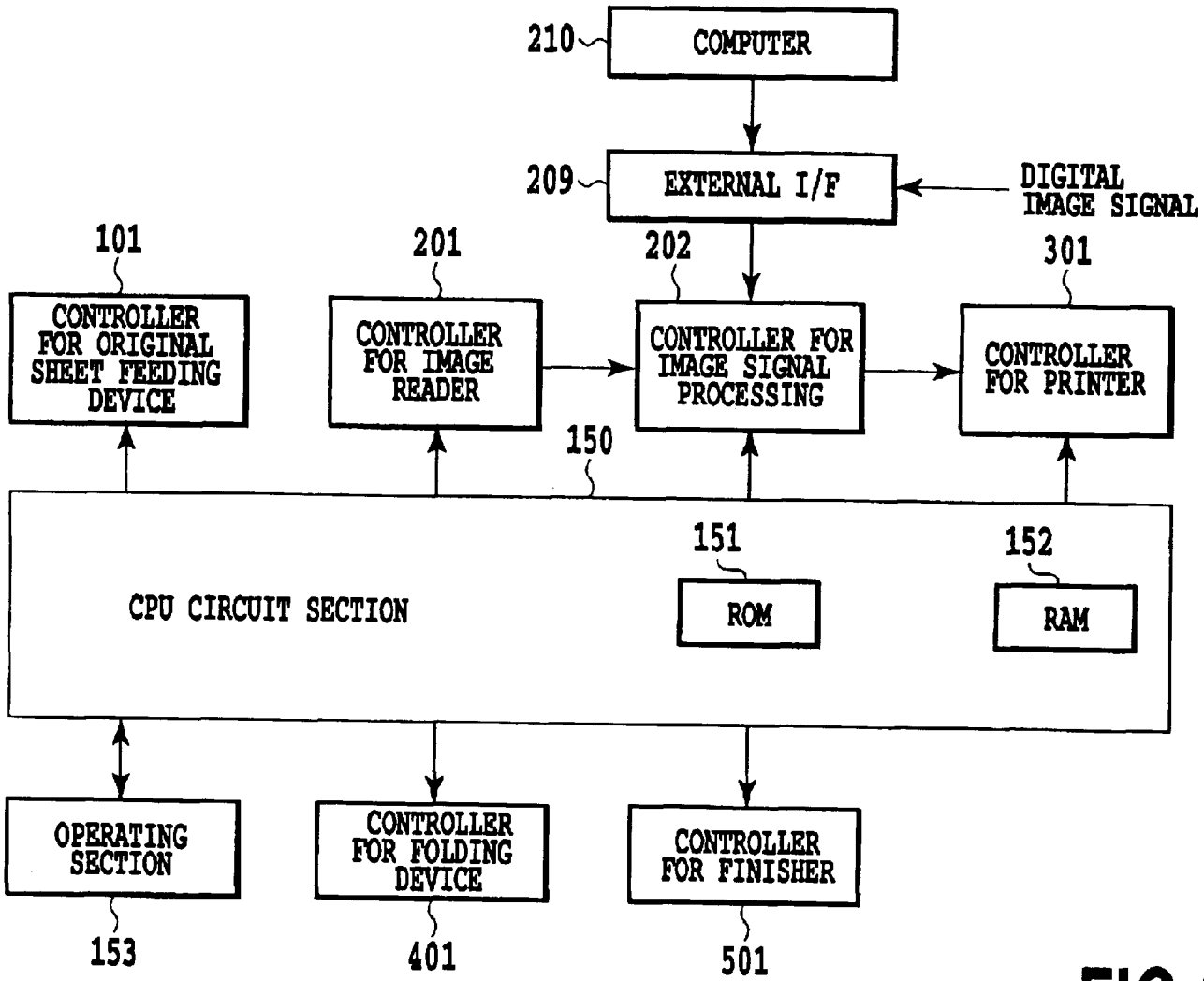
FIG. 2 is a block diagram illustrating the composition of the control device of the image forming apparatus given in FIG. 1.

Next, the composition of the controller, designed for controlling the whole of the present image forming apparatus, will be described referring to FIG. 2. FIG. 2 is a block diagram showing the composition of the controller for controlling the whole of the image forming apparatus given in FIG. 1.

The controller, as shown in FIG. 2, comprises a CPU circuit section 150. The CPU circuit section 150 incorporates the CPU (not shown), ROM 151 and RAM 152 and generally controls the blocks 101, 153, 201, 202, 209, 301, 401 and 501 by means of a control program stored in the ROM 151. The RAM 152 not only temporarily stores the control data but also is used as an operation area for the operation processing accompanying the control operation.

The controller 101 for original sheet feeding device controls the drive of the original feeding device 100 according to the command from the CPU circuit section 150. The controller 201 for image reader controls the drive of the scanner unit 104, the image sensor 109 or the like and transports the analog image signal, outputted from the image sensor 109, to the image signal controller 202.

The controller 202 for image signal processing converts the analog signal from the image sensor 109 into the corresponding digital signal and performs the subsequent processing to convert the digital signal into the video signal to be outputted to the printer controller 301. Further, the image signal, inputted from the computer 210 by way of the external I/F 209, is made to undergo various processing to convert the digital image signal into the video signal to be outputted to the printer controller 301. The processing operation of the controller 202 for image signal processing is controlled by the CPU circuit section 150. The controller 301 for printer drives the exposure controller 110 according to the inputted video signal.

The operating section 153 comprises a plurality of keys for setting various functions relating to the image formation, the display section for displaying the information concerning the setting conditions or the like not only to output the key signals corresponding to the operations of various keys to the CPU circuit section 150 but also to display the information corresponding to the signal from the CPU circuit section 150 on the display section.

The controller 401 for folding device is mounted on the folding device 400 and controls the drive of the whole folding device 400 by exchanging the information with the CPU circuit section 150.

The controller 501 for finisher is mounted on the finisher 500 and controls the drive of the whole finisher by exchanging the information with the CPU circuit section 150. The content of the control will be described later.

(Folding Device)

Figure 3:
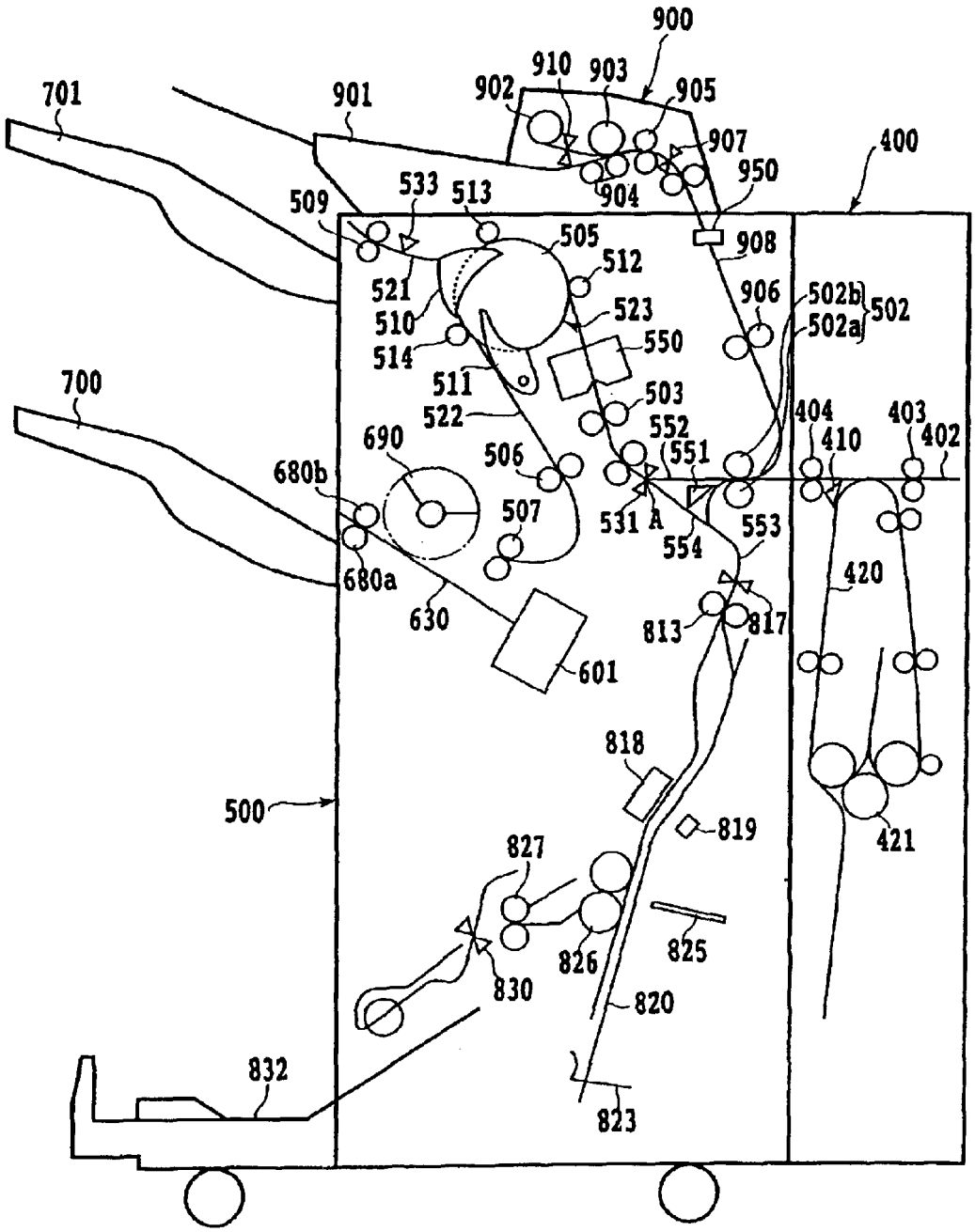
FIG. 3 is a schematic block diagram illustrating the constructions of the folding device and the finisher respectively incorporated into the image forming apparatus given in FIG. 1.

Next, the compositions of the folding device 400 and the finisher 500 will be described respectively referring to FIG. 3. FIG. 3 shows the compositions of the folding device 400 and the finisher 500, which are given in FIG. 1, respectively.

The folding device 400, as shown in FIG. 3, is provided with the folding and horizontal transport pass 402 for introducing the sheet discharged from the printer 300 and guiding the sheet to the side of the finisher 500. The pair of transport rollers 403 and the pair of transport rollers 404 are respectively provided on the folding and horizontal transport pass 402. Further, the exit (on the side of the finisher 500) of the folding and horizontal transport pass 402 is provided with the folding pass selecting flapper 410. This folding pass selecting flapper 410 performs the switching operation for guiding the sheet to the side of the folding and transport horizontal pass 402 or to the side of the finisher 500.

At this stage, when executing the folding operation, the folding pass selecting flapper 410 is turned on to guide the sheet to the folding pass 420. The sheet guided to the folding pass 420 is transported to the folding roller 421 to be folded in zigzag. In contrast, when the folding operation is not needed, the folding path selecting flapper 410 is turned off to transport the sheet directly to the finisher 500 from the printer 300 by way of the folding and transport horizontal pass 402.

(Finisher Main Section)

The finisher 500 sequentially takes in the discharged sheets by way of the folding device 400 and subsequently performs the post-processing for the taken-in sheets such as the processing for orderly collecting a plurality of taken-in sheets into a bundle, the processing for stapling the rear end of the collected sheet bundle, the processing for punching the area near the rear end of the taken-in sheets, the processing for sorting, the processing for non-sorting, processing for bookbinding or the like.

The finisher 500, as shown in FIG. 3, is provided with a pair of entrance rollers 502 for guiding inside the sheet discharged from the printer 300 by way of the folding device 400. The switching flapper 551 for guiding the sheet to the finisher path 552 or the first binding path 553 is provided on the downstream side of the pair of entrance rollers 502.

The sheet guided to the finisher path 552 is transported to the buffer roller 505 by way of the pair of the transport rollers 503. Both the pair of transport rollers 503 and the buffer roller 505 are respectively designed to be able to rotate in reverse direction.

The entrance sensor 531 is provided between the pair of entrance rollers 502 comprising rollers 502*a* and 502*b* and the pair of transport rollers 503. Further, the second binding pass 554 is diverged from the finisher pass 552 on the upstream side of the entrance sensor 531 in the sheet transport direction. Hereinafter, this diverging point is called the divergence A. This divergence A forms the divergence to the transport pass for transporting the sheet to the pair of transport rollers 503 from the pair of entrance rollers 502, but the divergence A also forms the one-way divergence for transporting only to the side of the second binding pass 554 when the sheet is transported to the side of the entrance sensor 531 from the side of the pair of transport rollers 503 by the reverse rotation of the pair of transport rollers 503.

A punch unit 550 is provided between the pair of transport rollers 503 and the buffer roller 505. The punch unit 550 operates to punch the area near the rear end the transported sheet when necessary.

The buffer roller 505 is designed for permitting, when necessary, the predetermined number of sheets to accumulate and wind around the periphery thereof by means of the downward pressure rolls 512, 513 and 514 when the sheets are fed around the periphery thereof. The sheets wound around the buffer roller 505 are transported in the direction of the rotation of the buffer roller 505.

The switching flapper 510 is interposed between the downward pressure rolls 513 and 514, and the switching flapper 511 is provided on the downstream side of the downward pressure roll 514. The switching flapper 510 is designed to unwind the sheets, which have been wound around the buffer roller 505, from the buffer roller 505 and guide the unwound sheets to the non-sort pass 521 or the sort pass 522, while the switching flapper 511 is designed to unwind the sheets, which have been wound around the buffer roller 505, from the buffer roller 505 and guide the unwound sheets to the sort pass 522 or guide the sheets wound around the buffer roller 505, as they are, to the buffer pass 523.

The sheets guided to the non-sort pass 521 by means of the switching flapper 510 are discharged onto the sample tray 701 by way of the pair of discharging rollers 509. The discharged paper sensor 533 which detect the jam or the like is provided on the way to the non-sort pass 521.

The sheet guided to the sort pass 522 by the switching flapper 510 is loaded on the intermediate tray (hereinafter referred to as processing tray) 630 by way of the pairs of the transport rollers 506 and 507. The sheets loaded in the form of the bundle on the processing tray 630 undergo the matching process, stapling process or the like, when necessary, and then are discharged onto the stack tray 700 by means of the roller 690 and the discharging rollers 680*a* and 680*b*. The stapler 601 is used in stapling process wherein the sheets accumulated in bundle on the processing tray 630 are stapled. The operation of the stapler 601 will be described later. Stack tray 700 is designed so as to be capable of traveling upward and downward directions by itself.

(Bookbinding Section)

The sheets from a first binding pass 553 and that from a second bookbinding pass 554 are stored in a storage guide 820 by the pair of transport rollers 813 and are further transported until the front end of each sheet comes into contact with a movable sheet-positioning member 823. A binding stage entrance sensor 817 is provided on the upstream side of the pair of transport rollers 813. Further, two pairs of staplers 818 are provided on the way to the storage guide 820. The staplers 818 are designed to cooperating with opposing anvil 819 to bind the bundle of the sheets at the center thereof.

The pair of folding rollers 826 is provided on the downstream side of a stapler 826. A thrusting member 825 is provided opposing to the pair of folding rollers 826. When this thrusting member 825 is projected towards the bundle of sheets stored in the storage guide 820, the bundle of the sheets is pushed out between the pair of folding rollers 826 to be folded by the pair of folding rollers 826 and then discharged onto the saddle discharge tray 832 by way of the pair of folded sheet discharge rollers 827. A sheet-from-binder discharge sensor 830 is provided on the downstream side of the pair of folded sheet discharge rollers 827.

When folding the bundle of sheets which has been bound by the stapler 818, the positioning member 823 is lowered by a predetermined distance so that the stapled position of the bundle of sheets coincides with the central position of the pair of folding rollers 826.

(Inserter Section)

Inserter 900 is mounted on the finisher 500. A bundle of sheets loaded on the tray 901 used as the covers or for use as a set of insert sheets is sequentially separated into individual sheet and then each sheet is transported to the finisher pass 552 or the binding pass 553. At this stage, the insert sheets or special sheets are loaded on the tray 901 of the inserter 900 in normal state when viewed from the position of the operator. In other words, the special sheets are loaded on the tray 901 with their faces up.

The special sheets loaded on the tray 901 are transported to a separating stage, comprising a transport roller 903 and a separation belt 904, by means of sheet feeding roller 902 so that the bundle of sheets is separated one by one from the top for being transported.

The pair of draw-out rollers 905 is provided on the downstream side of the separating stage. The special sheets separated by the pair of draw-out rollers 905 is stably guided to the transport pass 908. The feeding sheet sensor 907 is provided on the downstream side of the pair of draw-out rollers 905, while the pair of transport rollers 906, for guiding the special sheet on the transport pass 908 to the pair of entrance rollers 502, is provided between the feeding sheet sensor 907 and the entrance roller pair 502.

The transport pass 908 is provided with the overlapped transport detection sensor 950 for determining whether 2 or more special sheets separated and transported from tray 901 are transported in overlapped condition.

(Block Diagram of Finisher)

Figure 4:
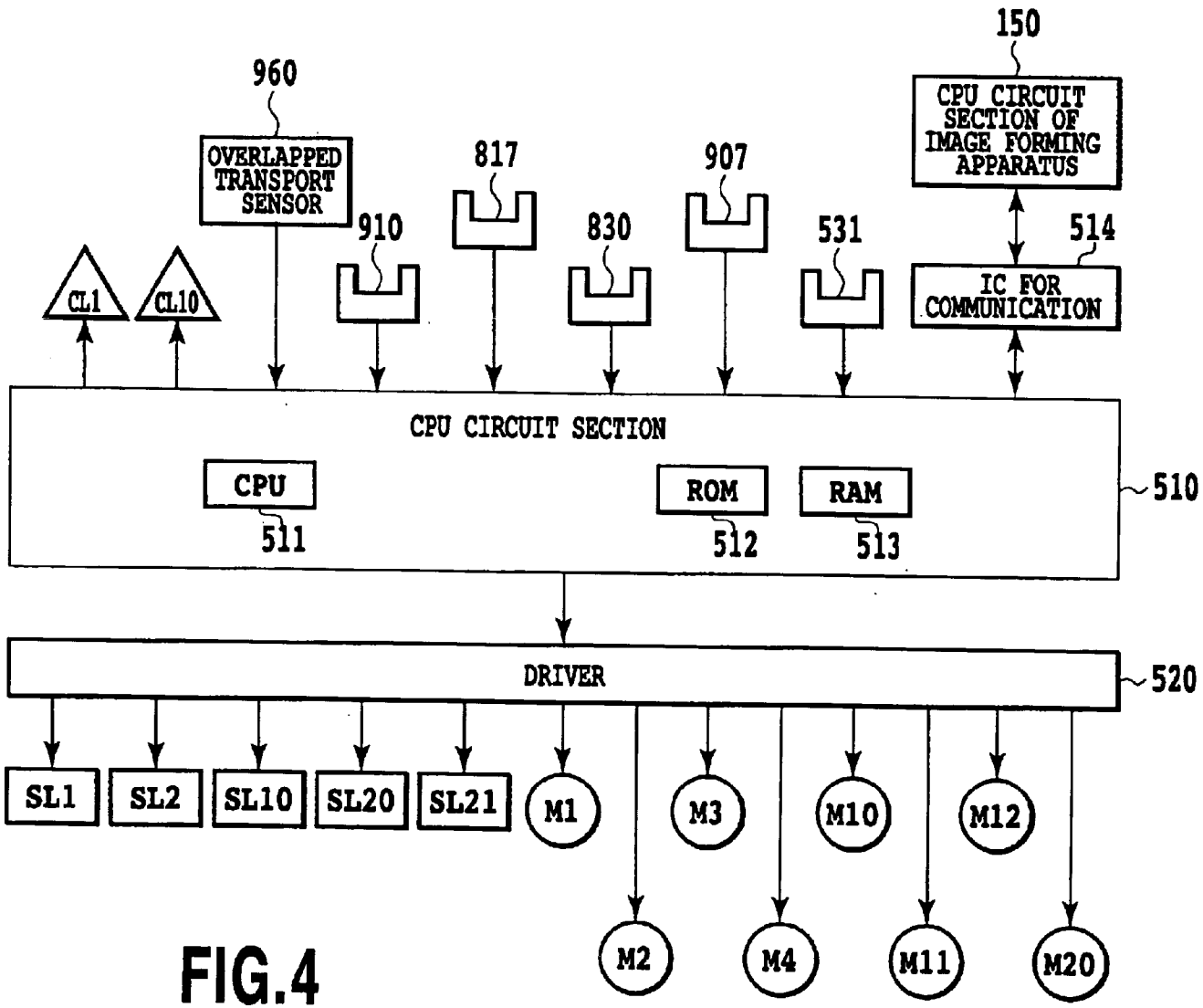
FIG. 4 is a block diagram illustrating the composition of the controller for finisher to control the finisher given in FIG. 3.

Next, the composition of the controller 501 for the finisher for controlling the drive of the finisher will be described referring to FIG. 4. FIG. 4 is a block diagram showing the composition of the finisher controller given in FIG. 2.

The controller 501 for the finisher, as shown in FIG. 4, is provided with the CPU circuit section 510, which comprises CPU 511, ROM 512, RAM 513 or the like. The CPU circuit section 510 exchanges the data with the CPU circuit section 150, which is provided on the side of the main unit of the image forming apparatus, through communication IC 514, and executes various programs stored in the ROM 512 according to the commands from the CPU circuit section 150 to control the drive of the finisher 500.

In performing the above-mentioned control of the drive, the CPU circuit section 510 receives the signals detected by the various sensors. Such various sensors are the entrance sensor 531, the binding stage entrance sensor 817, the binding stage sheet discharge sensor 830, the feeding sheet sensor 907, the set sheet sensor 910, and the overlapped sheets transport sensor 960. The set sheet sensor 910 is designed for detecting whether or not the special sheets are loaded on the tray 901 of the inserter 900. The overlapped sheets transport sensor 960 is designed, as described previously, for detecting whether or not the sheets, which have been transported separately from the tray 901, have been transported in a condition such that two or more special sheets are overlapped. The overlapped sheets transport sensor comprises a stationary electrode and a moving electrode which are arranged opposing each other and designed so that thickness of the sheet passing between the opposing electrodes is measured in terms of the electrostatic capacity of the sheet while the sheet is transported passing through the position of the sensor. Needless to say, any other measuring method may be substituted for the present method as long as the substitutive method is capable of detecting the overlapped transport of sheets. The CPU circuit section 510 is connected with the driver 520. The driver 520 drives the motor and the solenoid according to the signals from the CPU circuit section 510. Further, CPU circuit section 510 also drives the clutch.

In this embodiment, the motors provided are the entrance motor M1 as being the drive source of the pair of entrance rollers 502, the pair of transport rollers 503 and the pair of transport rollers 906; the buffer motor M2 as being the driving source of the buffer roller 505; the sheet discharging motor M3 as being the driving source for each pair of the transport rollers 506, the pair of discharging rollers 507 and the pair of discharging rollers 509; the bundle discharging motor M4 as being the driving source for each of the discharging motor M4 as being the driving source for each of the discharging rollers 680*a* and 680*b*; the transport motor M10 as being the driving source of the pair of transport rollers 813; the positioning motor M11 as being the driving source of the sheet positioning member 823; the folding motor M12 as being the driving source of the thrusting member 825, the pair of folding rollers 826 and the pair of folded sheet discharging rollers 827; and sheet feeding motor M20 as being the driving source of the sheet feeding roller 902, the transport roller 903, the separation belt 904 and the pair of draw-out rollers 905 of the inserter 900.

The entrance motor M1, the buffer motor M2, the sheet discharging motor M3 and the bundle discharging motor M4 are the stepping motors, each of which is capable of letting the roller pairs rotate at constant speeds or at different speeds respectively by controlling the exciting pulse rate thereof. Further, the entrance motor M1 and the buffer motor M2 can be driven either normal direction or reverse direction by means of the driver 520.

The transport motor M10 and the positioning motor M11 are stepping motors, while the folding motor M12 is a DC motor. Further, the speed of the transport motor 10 can be synchronously equalized to the speed of the entrance motor M1 in transporting the sheets.

The paper feeding motor M20 is a stepping motor, which is designed to be capable of operating at synchronously equal speed to that of the entrance motor M1 in transporting the sheets.

There are provided the solenoid SL1 for the switching of the switching flapper 510, the solenoid SL2 for the switching of the switching flapper 511, the solenoid SL10 for the switching of the switching flapper 551, the solenoid SL20 for driving the sheet feeding shutter (not shown in FIG. 3) of the inserter 900, and the solenoid SL21 for driving the sheet feeding roller 902 for ascending and descending thereof.

There are provided the clutch CL1 for transmitting the drive of the folding motor M12 to the thrusting member 825 and the clutch CL10 for transmitting the drive of the sheet feeding motor M20 to the feed sheet roller 902.

(Operating Section)

Figure 5A:
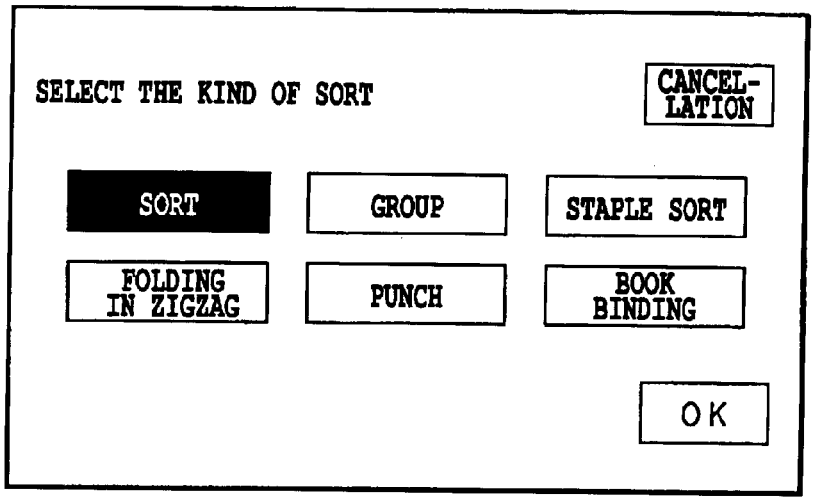
FIGS. 5A, 5B and 5C are schematic illustrations of the examples of the setting screen respectively to be outputted through the display unit of the operating section.
Figure 5B:
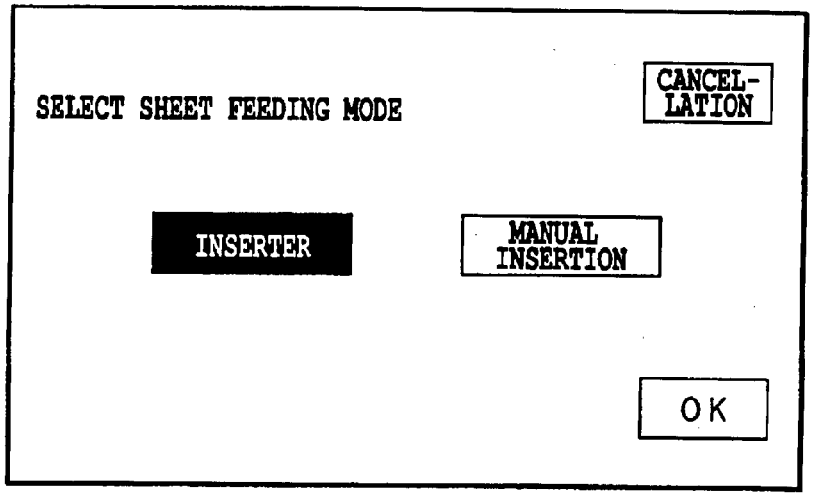
Figure 5C:
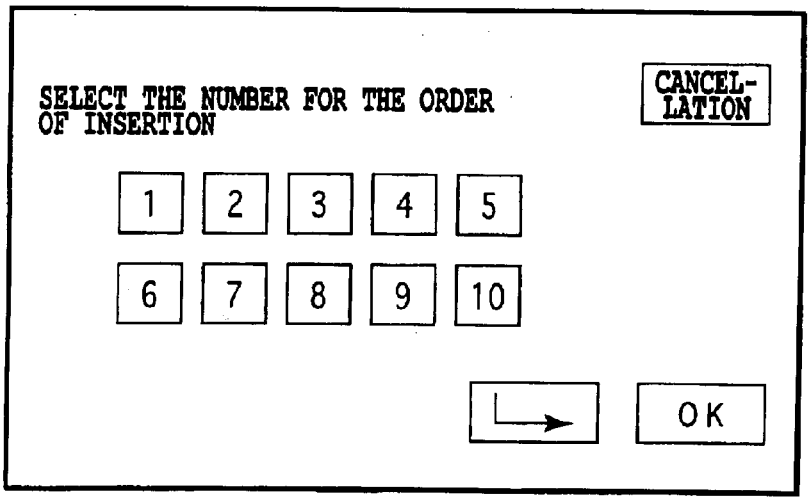

Next, the example of the selective operation in the post-processing mode by the operating section will be described referring to FIGS. 5A–5C. FIGS. 5A–5C show the examples of the menu for selecting the post-processing mode of the operating section in the image forming apparatus given in FIG. 1.

In the present image forming apparatus, not only such various processing modes as the non-sort mode, sort mode, staple sort mode (stapling mode), bookbinding mode or the like are available but also the sheet inserting mode for enabling the sheets to be added as the front cover or the back cover or inserted into any places is available. Such processing modes can be set through the input operation from the operating section 153. For example, in setting the post-processing mode, the menu to be selected shown in FIG. 5A is displayed on the operating section 153 so that the processing mode can be set by means of the displayed menu. Further, in setting the sheet inserting mode, the menu to be selected shown in FIG. 5B can be displayed on the operating section 153 so that not only whether the insert sheet is to be made by means of the inserter 900 or to be made manually by means of manual sheet feeder 125 can be selected but also the place where the insertion is to be made can also be selected through the menu shown in FIG. 5C. When feeding the special sheet exclusively for use as the cover, only [1] should be selected. However, when a plurality of sheets are to be inserted, it is possible to selectively specify the desired places where the insertions are to be made.

(General Description of Operation of Finisher)

Next, the process for transporting the sheet to the processing tray 630 in the finisher 500 from the inserter 900 and the printer 300 during the sort mode will be described referring to FIGS. 6 through 11. FIGS. 6 through 11 illustrate the flow of the sheet from the inserter and the printer to the processing tray in the finisher when the image forming apparatus is set in the sort mode.

Figures 6A, 6B:
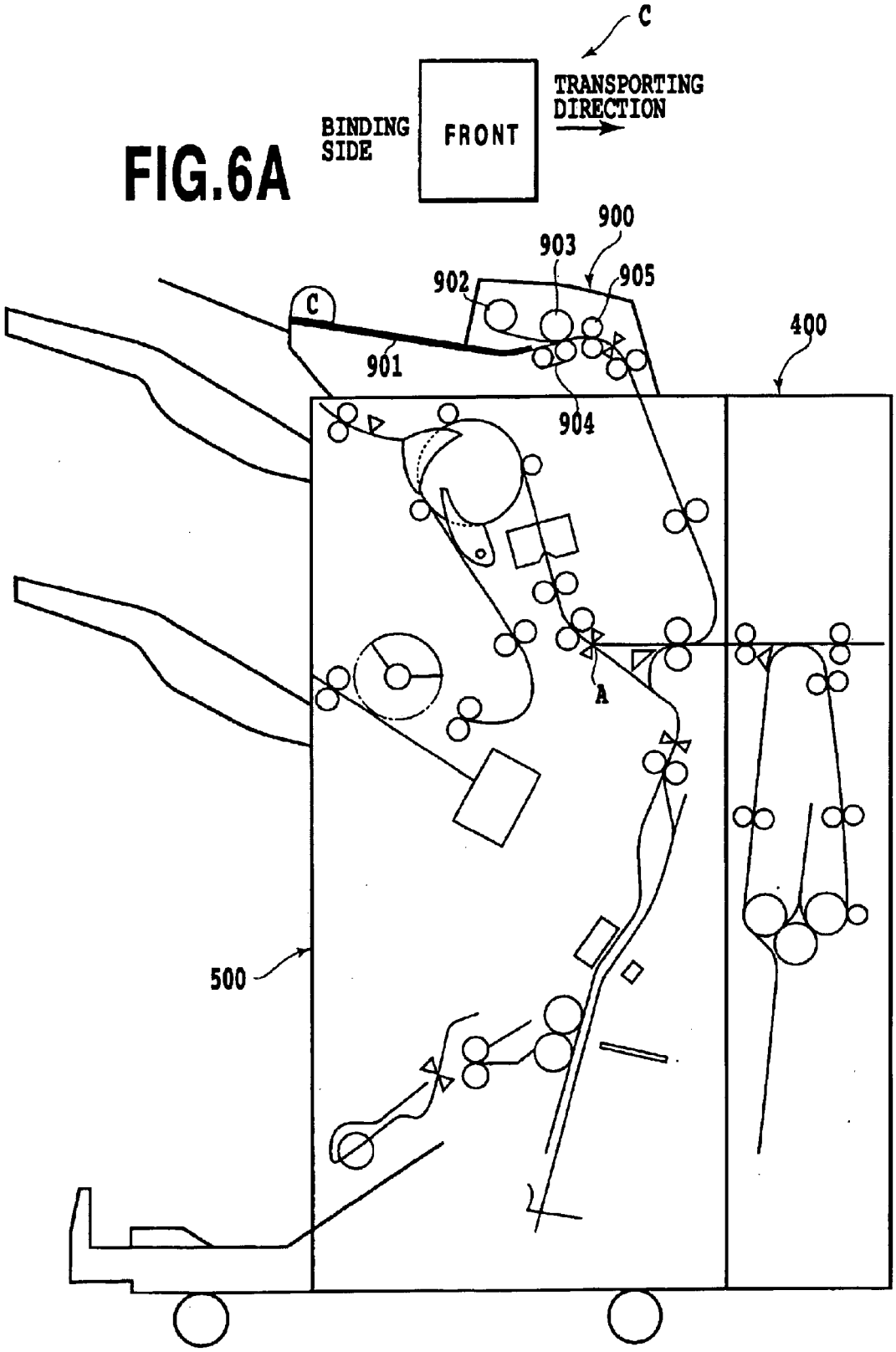
FIGS. 6A and 6B are the first schematic diagram for illustrating the procedures for transporting the sheets to the processing tray of the finisher from the main unit of the image forming apparatus and the inserter.

When inserting the sheet C, for use as a cover, is to be inserted among the sheets whereon the images have been formed, the sheet C is set on the tray 901 of the inserter 900, as shown in FIG. 6B. In this case, as shown in FIG. 6A, the sheet C is set so that the surface whereon the image is formed is set facing up and the place to be bound comes to left side when viewed from the position of the operator, whereby the sheet can be fed in the direction of the arrow in FIG. 6A. The set condition of the sheet C is similar to the set condition of the original in the original feeding device 100, thereby improving the efficiency in setting the sheet C.

Figure 7:
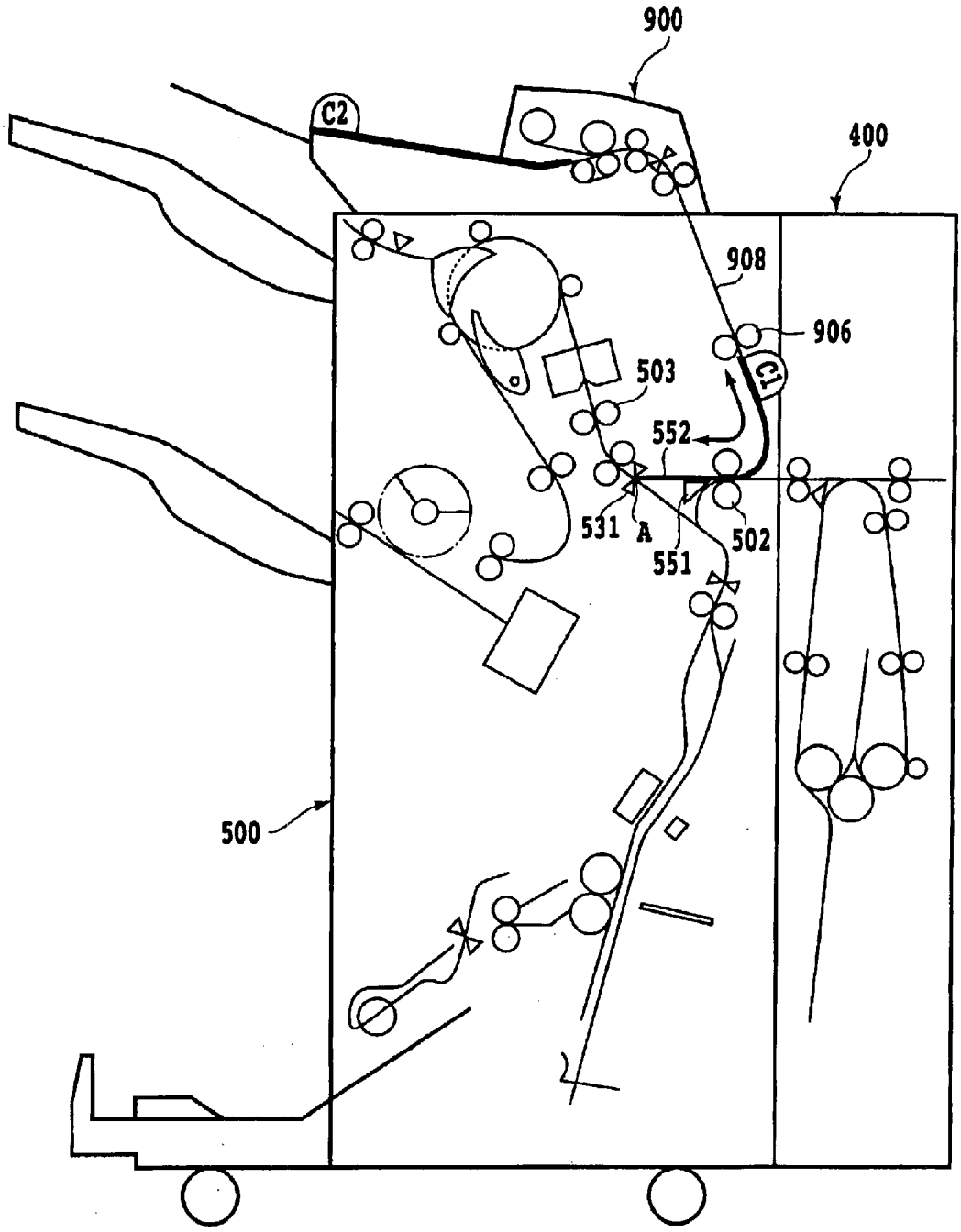
FIG. 7 is the second schematic diagram for illustrating the procedure for transporting the sheets to the processing tray of the finisher from the main unit of the image forming apparatus and the inserter.

When the sheets C is set on the tray 901, as shown in FIG. 7, the top sheet C1 starts to be fed while switching flapper 551 is switched to the side of the finisher pass 552. The sheet C1 is guided, from the transport pass 908, into the finisher pass 552 by way of the pair of entrance rollers 502, and, when the front end of the sheet C1 is detected by the entrance sensor 531, the feed of the sheet, whereon the image has been formed, from the printer 300 is started.

Figure 8:
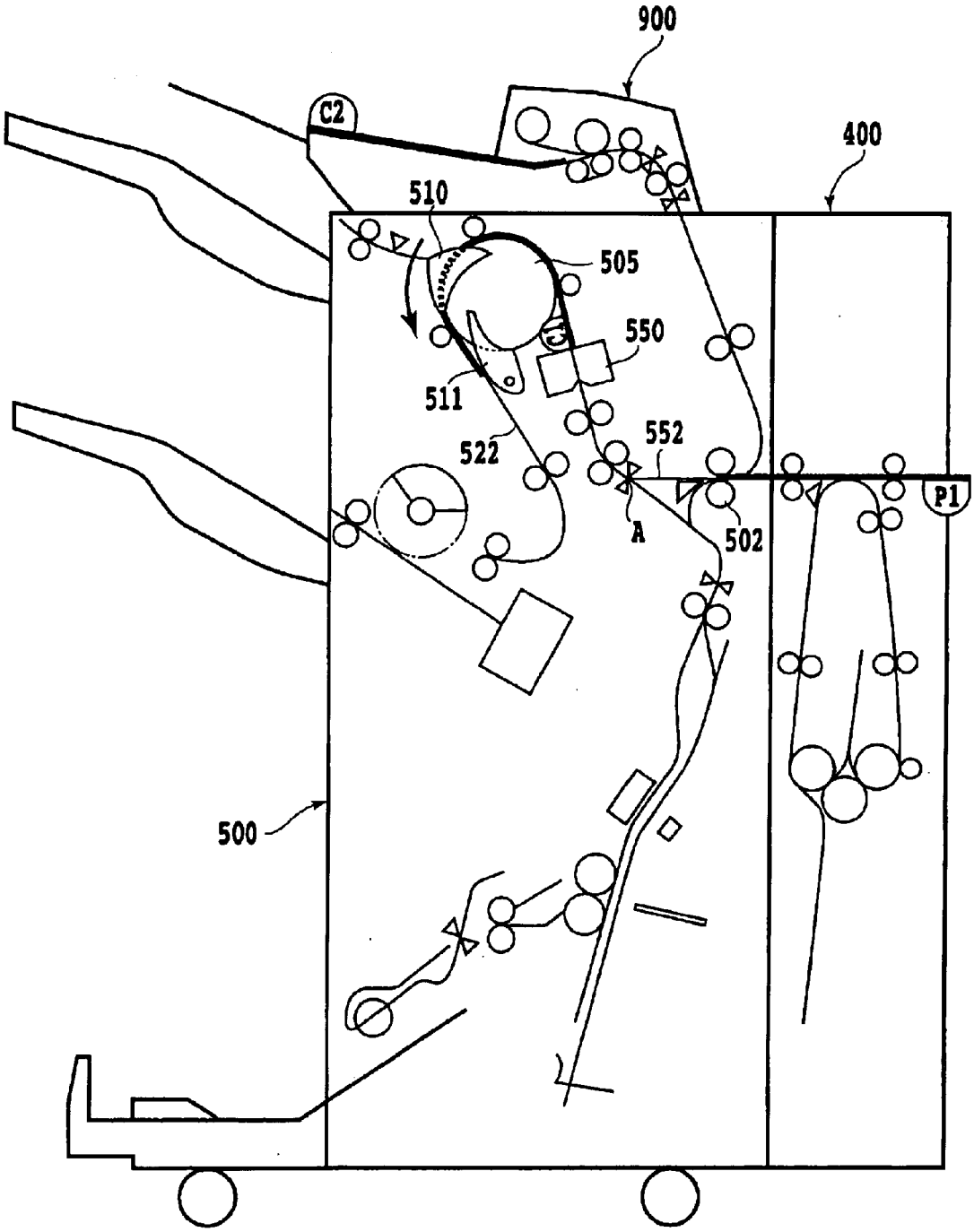
FIG. 8 is the third schematic diagram for illustrating the procedure for transporting the sheets to the processing tray of the finisher from the main unit of the image forming apparatus and the inserter.

Subsequently, as shown in FIG. 8, not only the sheet P1 supplied from the printer 300 is guided into the finisher 500 but also the sheet C1 is guided to the sort pass 522 by way of the buffer roller 505. During this process, the both the switching flappers 510 and 511 are switched to the side of the sort pass 522 respectively.

Figure 9:
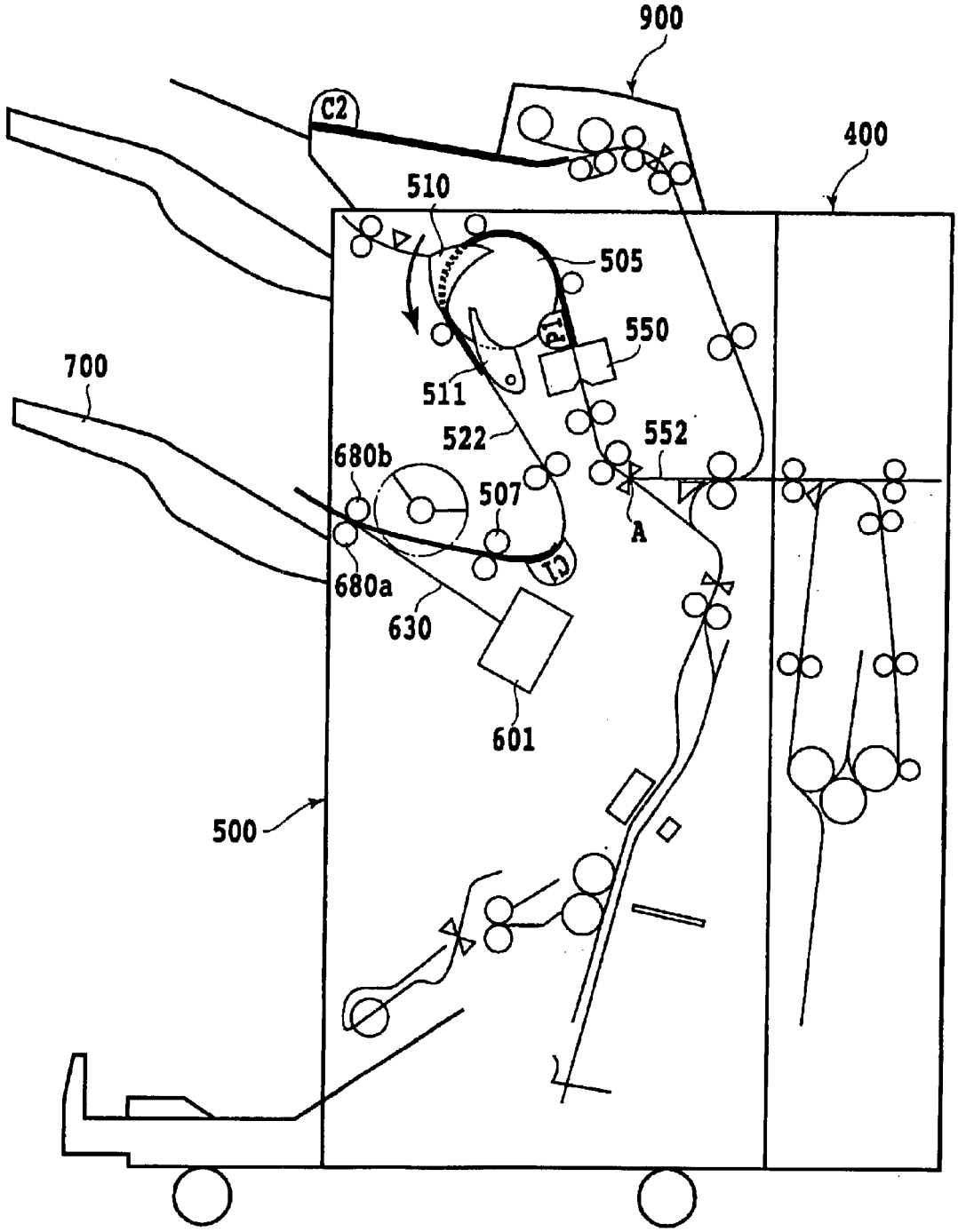
FIG. 9 is the fourth schematic diagram for illustrating the procedure for transporting the blank sheets to the processing tray of the finisher from the main unit of the image forming apparatus and the inserter.
Figure 10:
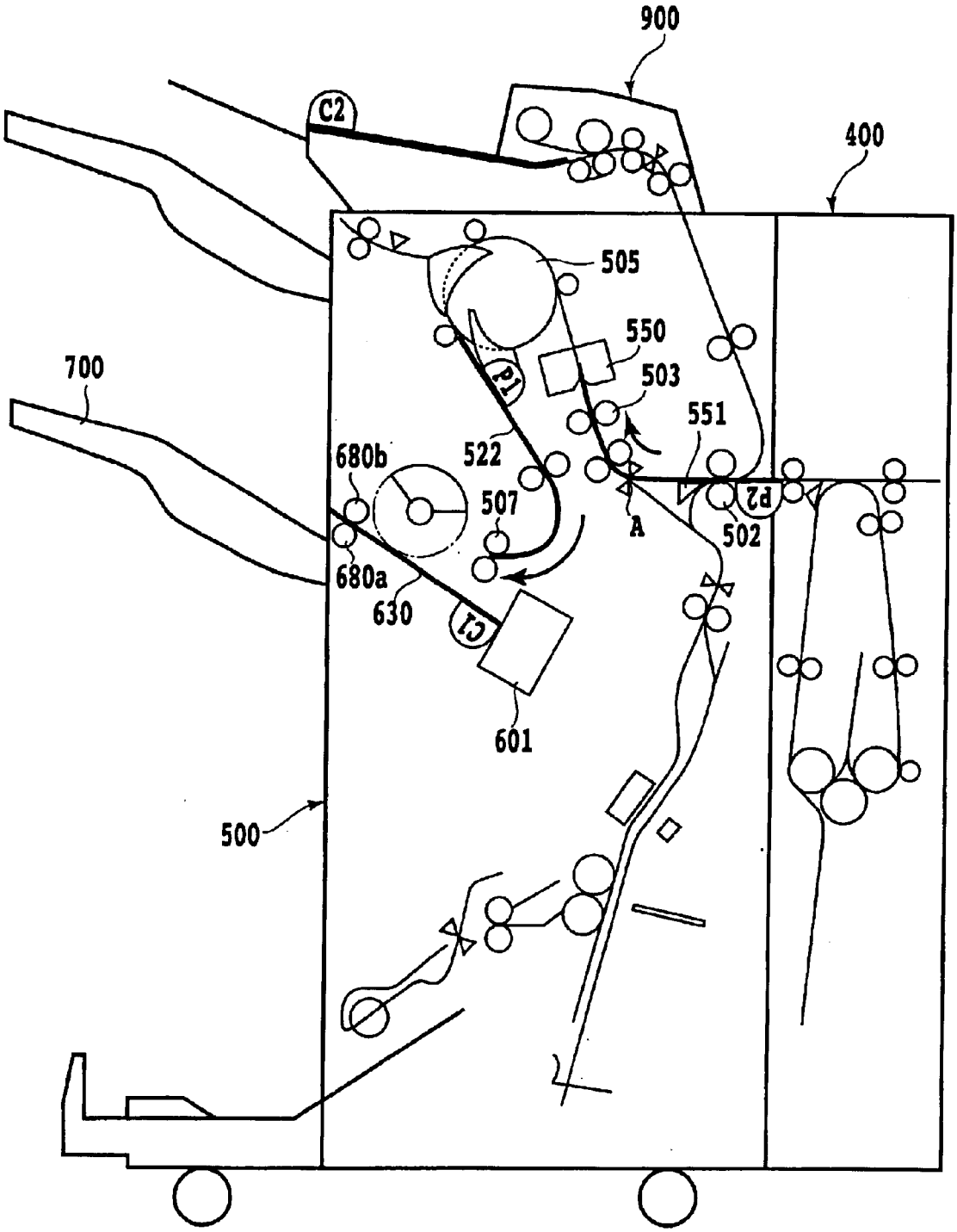
FIG. 10 is the fifth schematic diagram for illustrating the procedure for transporting the blank sheets to the processing tray of the finisher from the main unit of the image forming apparatus and the inserter.
Figure 11:
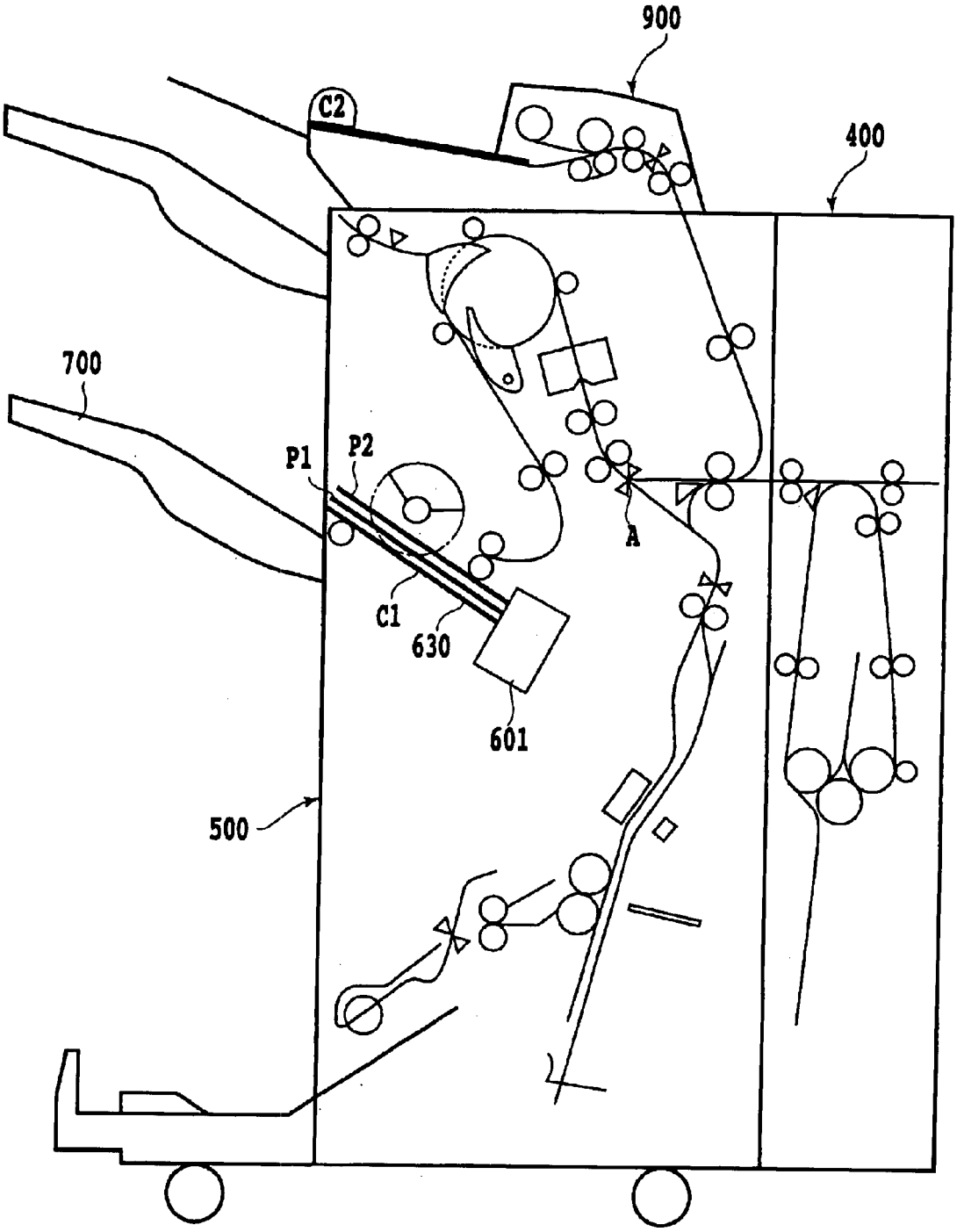
FIG. 11 is the sixth schematic diagram illustrating the procedure for transporting the blank sheets to the processing tray of the finisher from the main unit of the image forming apparatus and the inserter.

The sheet C1 guided to the sort pass 522 is stored in the processing tray 630 as shown in FIG. 9. In this process, the sheet P1 from the printer 300 has been guided into the finisher pass 522. Similarly to the case of the sheet C1, the sheet P1 is, as shown in FIG. 10, guided to the sort pass 522 by way of the buffer roller 505 and then transported to the processing tray 630. Further, the sheet P2, which follows the sheet P1, is guided into the finisher pass 552. Then, as shown in FIG. 11, the sheet P1 is stored by being placed on the sheet C1, which has already been stored in the processing tray 630, and the following sheet P2 is stored by being placed on the sheet P1.

At this stage, the images, which have undergone the processing for the reflected image, are formed on each of the sheet P1 and the sheet P2; since the sheet P1 and the sheet P2 have been discharged by means of the reversed sheet discharging process, similarly to the case of the sheet C1, each of the sheet P1 and the sheet P2 is stored in the processing tray 630, with its image forming surface down and with its side to be bound on the side of the stapler 601. Further, although not shown in FIG. 11, when there are the special sheets to be matched with the next bundle of the sheets, it is arranged that such special sheets are fed to the transport pass 908 for waiting while the sheet P1 and the sheet P2, which constitute the present bundle of sheets, are being transported. With this configuration, the productivity during the processing in the sort mode can be improved.

(General Description of Bookbinding Operation)

Next, the formation of the image during the bookbinding mode will be described referring to FIGS. 12A–12D. FIGS. 12A–12D contain the diagrams for illustrating the process of the image formation in the image forming apparatus given in FIG. 1 during the bookbinding mode.

When the bookbinding mode is specified, the originals set in the original feeding device 100 are scanned sequentially from the first page; the images scanned out from the originals are sequentially stored in the hard disk (not shown) while simultaneously counting the number of the scanned originals. For reference, the hard disk is an external memory incorporated into the controller 202 for image signal processing.

When the scanning of the original is finished, the original images, which have been scanned out, are classified according to the following formula (1) to decide on the sequence and the position of the image formation.

$$M=n\times 4-k \quad (1)$$

where M: Number of sheets of the originals n: any integer of 1 or more to represent the number of sheets k: any one of the values of 0, 1, 2 and 3

Here, the detailed descriptions for the control of the sequence and the position of the image formation are omitted.

Figure 12A:
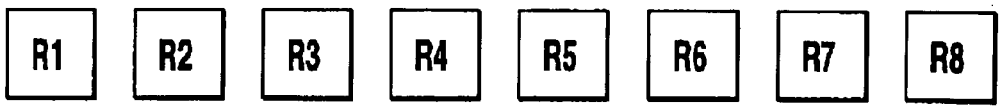
FIGS. 12A, 12B, 12C and 12D are schematic diagrams for respectively illustrating examples of the image forming procedure in the book binding mode in the image forming system shown in FIG. 1.

If the image formation process is described taking an example of the case where the number of sheets of the originals to be scanned is 8 sheets, as shown in FIG. 12A, the original image data for the 8 pages (R1 through R8) is stored in a hard disk according to the sequence of reading.

Figure 12B:
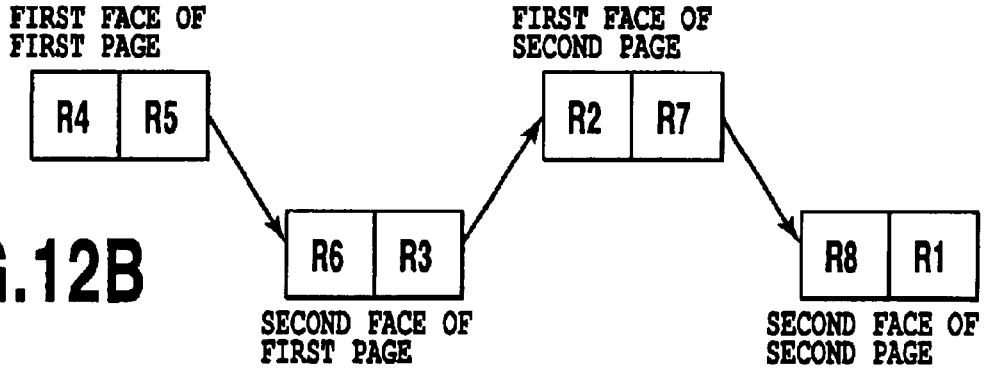

For each of the image data (R1 through R8), the sequence and the position of the image formation are decided. By doing so, as shown in FIG. 12B, after the previously described reflected image processing, the image of R4 is formed on the left-hand half of the first face (surface) of the sheet P1, the first page, while the image of R5 is formed on the right-hand half of the same, and the sheet P1 is guided to the two-side transport pass 124. Then, the sheet P1 is transported again to the transcribing device 116 to have the image of R6 formed on the left-hand half of the second face (back face) of the sheet P1 while having the image of R3 formed on the right-hand half thereof. Then, the sheet P1 with the images formed on both the surface and the back thereof is discharged after having the sides thereof reversed in the reversing process and transported to the binding pass 553 of the finisher 500. As the result of the discharge after reversing the sides, the sheet P1 is transported in the direction of an arrow as shown in the FIG. 12C with its second face up, the second face having the image of the R6 and the image of R3 formed thereon, and by being preceded by the image of R6.

Figure 12C:
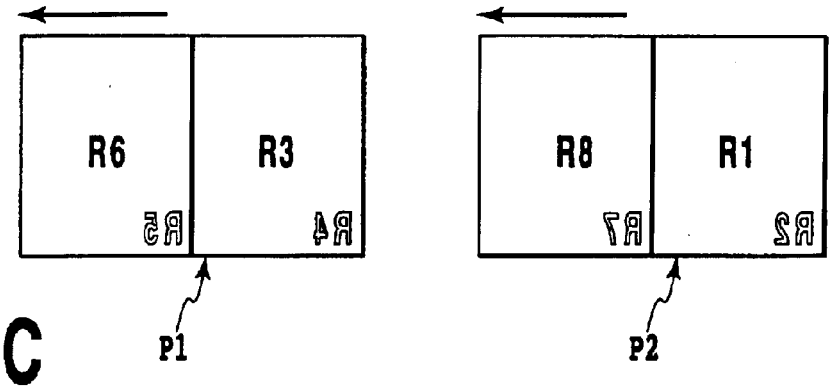

Subsequently, the image of R2 is formed on the left-hand half of the first face (surface) of the sheet P2, second page, while the image of R7 is formed on the right-hand half thereof, and the sheet P2 is guided to the two-side transport pass 124. The sheet P2 is fed again to the transcribing device 116 to have the image of R8 formed on the left-hand half of the second face (back face) thereof while having the R1 image formed on the right-hand half thereof. Then, the sheet P2 is turned over and discharged to the first binding pass 533 of the finisher 500. By undergoing this overturned discharge process, the sheet P2, as shown in FIG. 12C, is transported in the direction of an arrow as shown in the figure with its second surface up, the surface having the image of R8 and the image of R1 formed thereon, and by being preceded by the image of R8.

Figure 12D:
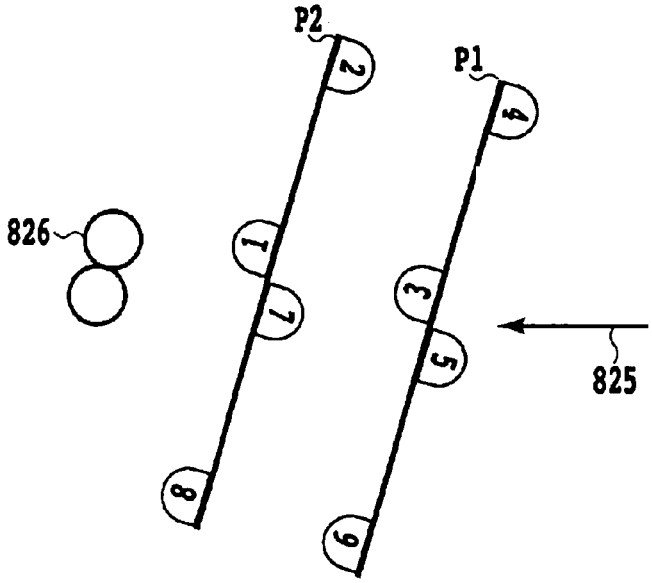

Each of the sheet P1 and the sheet P2 is guided into the storage guide 820 for being stored therein by way of the binding pass 553 of the finisher 500. This storage guide 820 is arranged, as shown in FIG. 12D, so that the sheet P1 is stored on the side of the thrusting member 825, while the sheet P2 is stored on the side of the folding roller 826 respectively. Further, each of the first face of the sheet P1 and sheet P2 is stored facing the side of the thrusting member 825.

The positioning of the each of the sheets P1 and P2 is made by means of the positioning member 823.

(General Descriptions of the Operations of Bookbinder and Inserter)

Figure 20A:
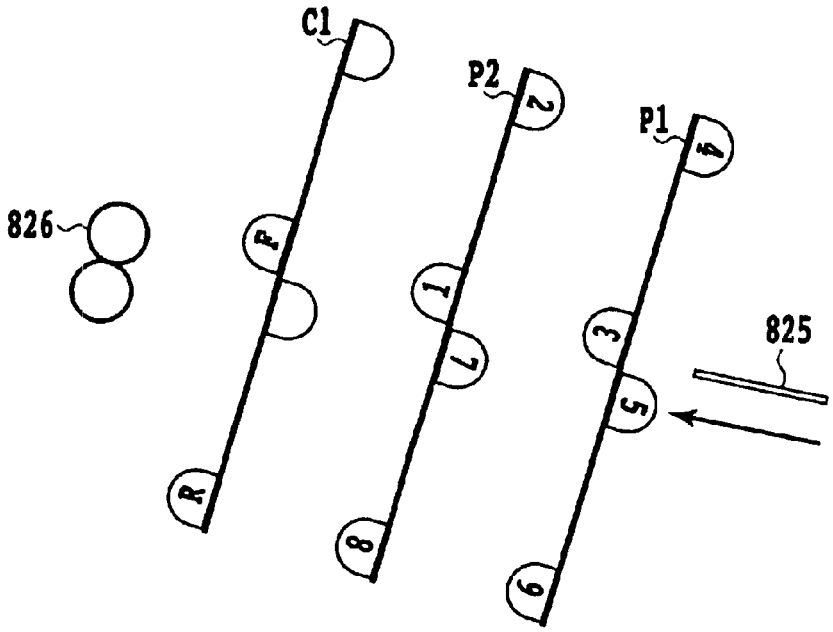
FIGS. 20A and 20B are the diagrams respectively showing an example of folding process and an example of the binding process in the finisher.
Figure 20B:
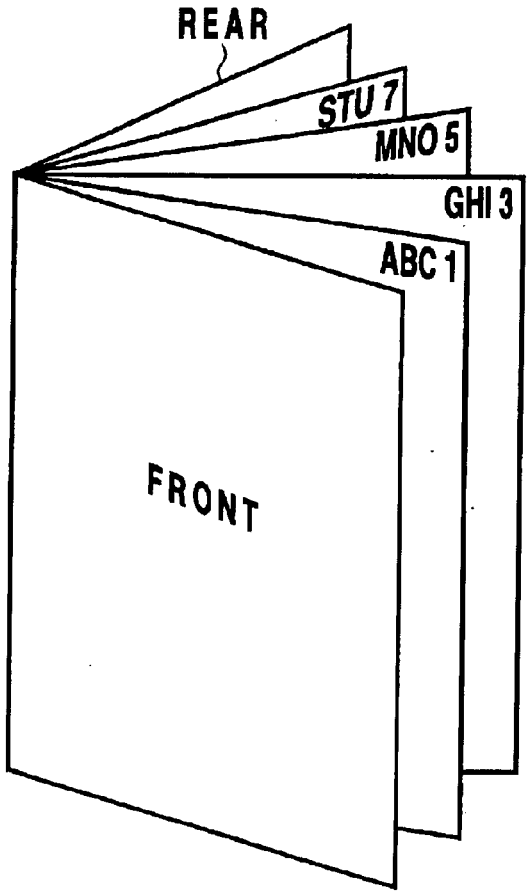

The transport of the sheet to the storage guide 820 in the finisher from the inserter 900 and the printer 300 during the bookbinding mode will be described referring to FIG. 13A through FIG. 20B. FIG. 13A through FIG. 19 illustrate the flow of the sheet from the inserter and the printer to the storage guide in the finisher to the storage guide during the bookbinding mode of the image forming apparatus shown in FIG. 1, while FIGS. 20A and 20B show an example of the bookbinding process consisting of the folding process and the binding process in the finisher shown in FIG. 3.

Figure 13A:
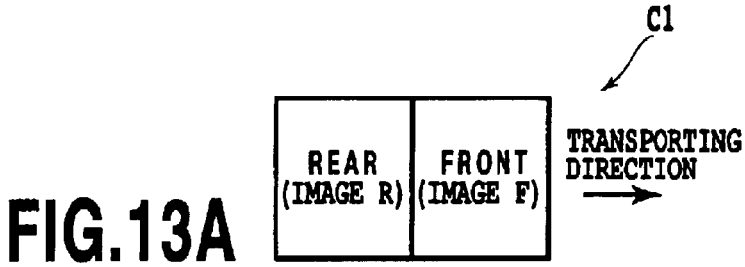
FIGS. 13A and 13B are the first schematic diagram for illustrating and the procedure for transporting the sheets to the storage guide of the finisher from the main unit of the image forming apparatus the inserter.
Figure 13B:
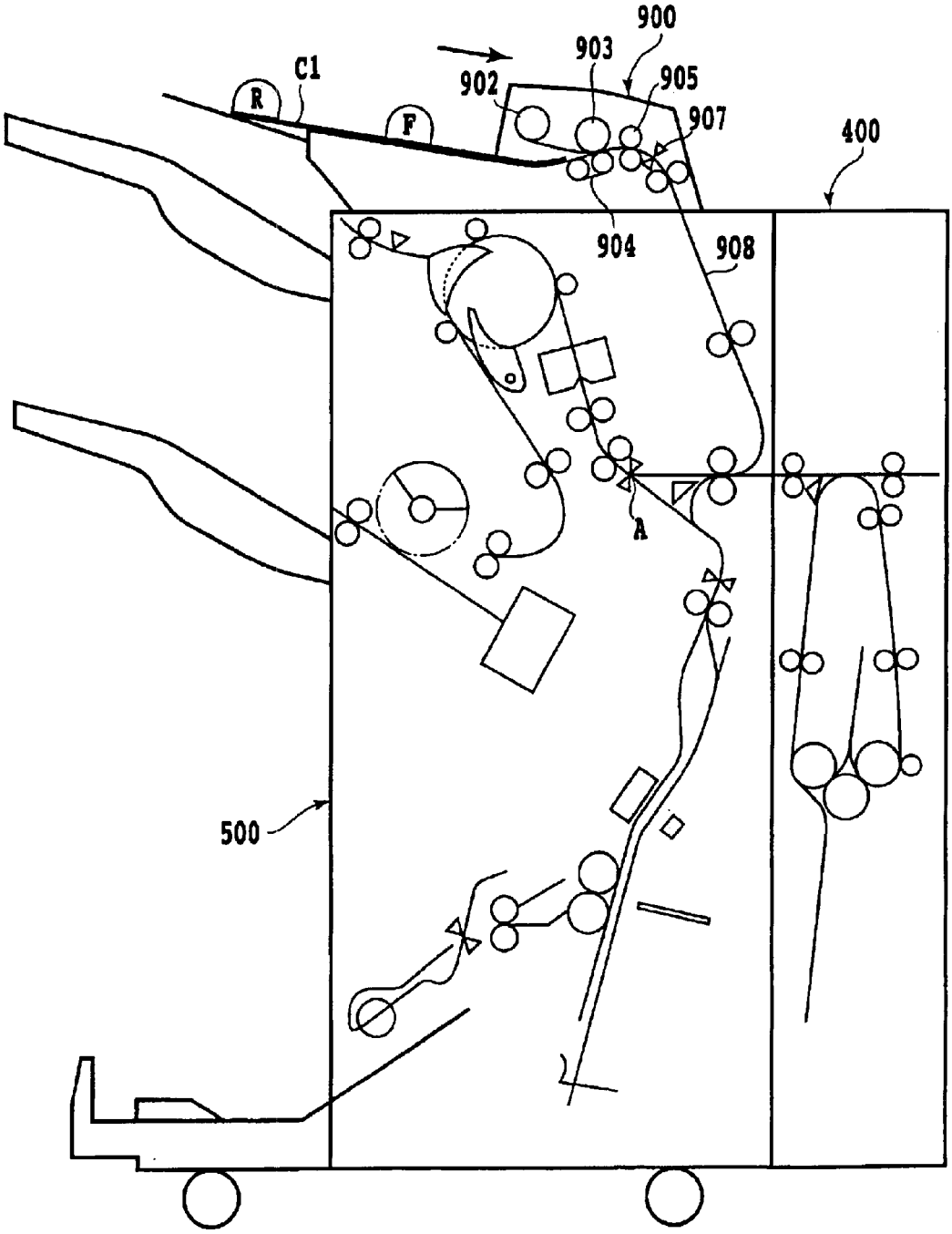

When binding the sheets by inserting the sheet C1 for use as a cover into the bundle of sheets whereon the images have been formed, as shown in FIG. 13B, the sheet C1 is set on the tray 901 of the inserter 900. In this case, as shown in FIG. 13A, the sheet C1 is set on the tray 901, with its surface, whereon the image R and the image F are formed, facing up, and transported by being preceded by the image F. In other words, the sheet C1 is set so that it can be seen in normal state by the operator or is set in the condition similar to that in which the original is set in the original feeding device 100. Therefore, efficiency of operation for setting the sheet C1 can be improved.

Figure 14:
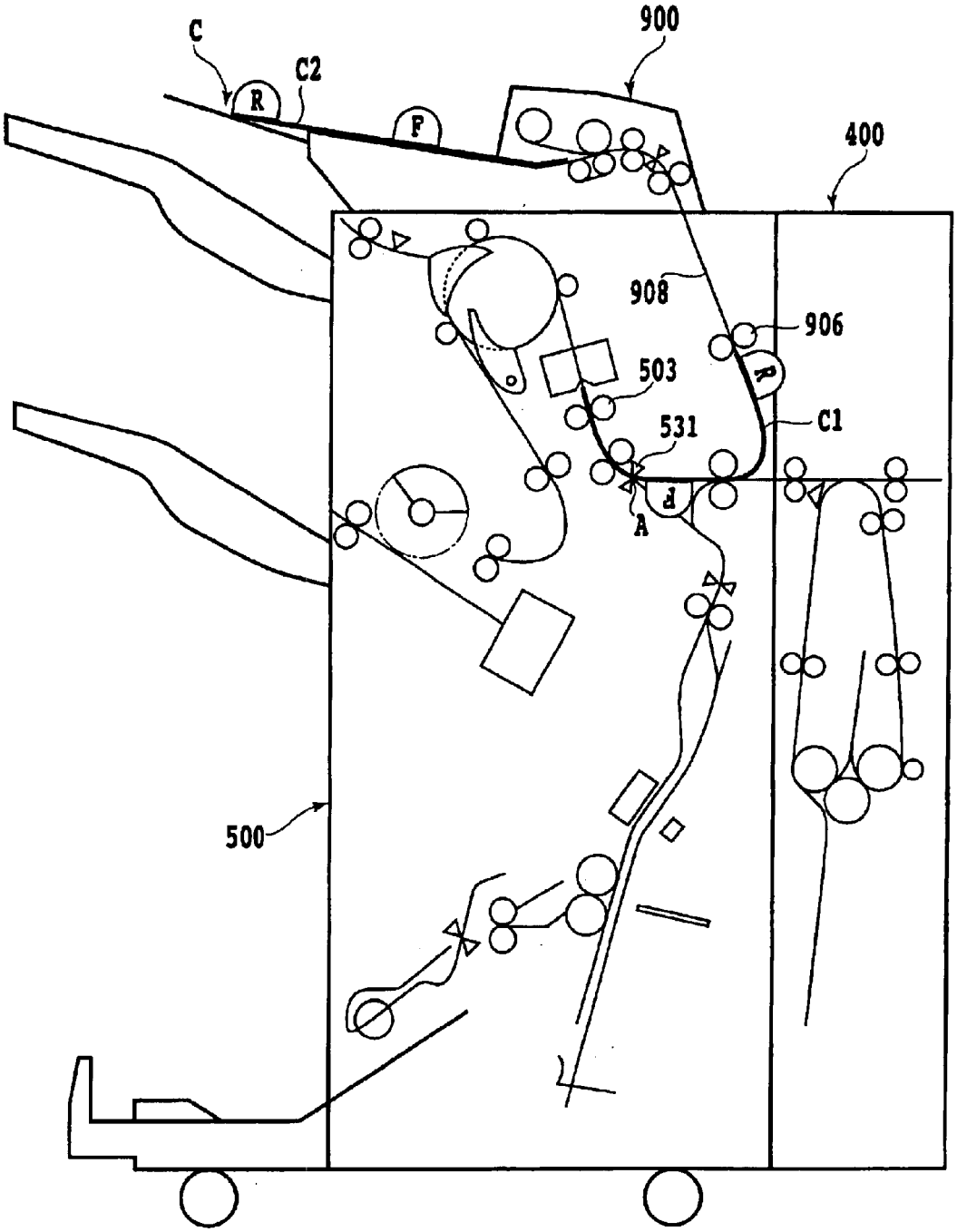
FIG. 14 is the second schematic diagram for illustrating the procedure for transporting the sheets to the storage guide of the finisher from the main unit of the image forming apparatus and the inserter.

When the sheet C1 is set in the tray 901, as shown in FIG. 14, the feed of the sheet C1 placed on the top of the insert sheets is started, and the switching flapper 551 is switched to the side of the finisher pass 552. The sheet C1 is guided into the finisher pass 552 from the transport pass 908 by way of the pair of entrance rollers 502, and, when the front end of the sheet C1 is detected by the entrance sensor 531, the feed of the sheet (the sheet P1 shown in FIG. 15), whereon the image has been formed, from the printer 300 will be started.

Figure 15:
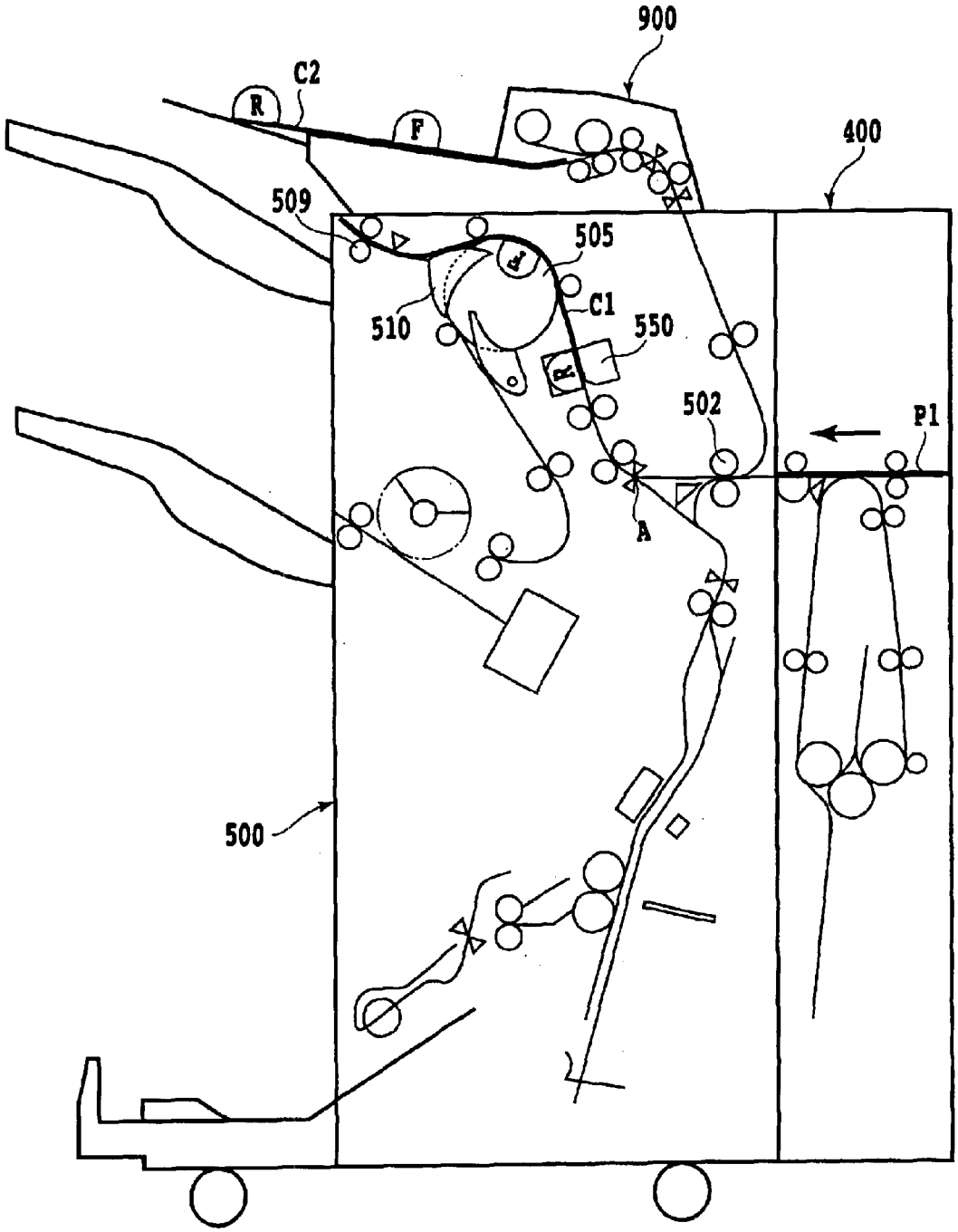
FIG. 15 is the third schematic diagram for illustrating the procedure for transporting the sheets to the storage guide of the finisher from the main unit of the image forming apparatus and the inserter.

Next, as shown in FIG. 15, not only the sheet P1 supplied from the printer 300 is guided into the finisher 500 but also the sheet C1 is guided to the side of the non-sort pass 521 by way of the buffer roller 505. In this case, the switching flapper 510 has already been switched to the side of the non-sort pass 521.

Figure 16:
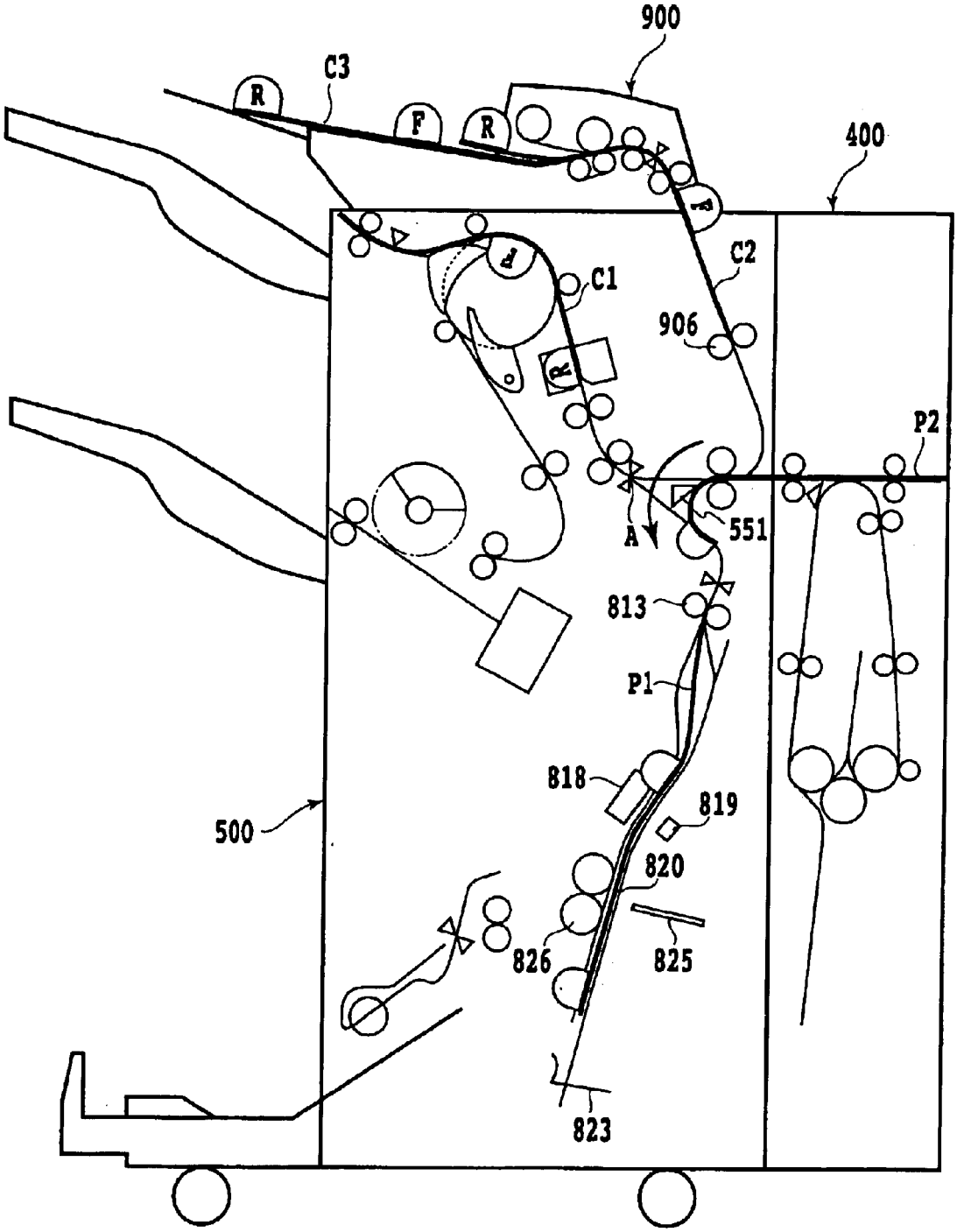
FIG. 16 is the fourth schematic diagram for illustrating the procedure for transporting the sheets to the storage guide of the finisher from the main unit of the image forming apparatus and the inserter.

Further, when the sheet C1 is guided to the side of the non-sort pass 521 and is further transported until its rear end passes through the entrance sensor 531, as shown in FIG. 15, the transport of the sheet C1 is stopped once. In this case, the sheet P1 from the printer 300 is guided into the finisher 500. Then, while the sheet C1 is stopped, the sheet P1 is, as shown in FIG. 16, guided to the first binding pass 553 by means of the switching flapper 551 to be stored in the storage guide 820, and the following sheet P2 is also guided to the first binding pass 553. In this case, the sheet C2 following the sheet C1 is separated and transported before the pair of transport rollers 906 to be kept waiting there until predetermined number of sheets P are stored in the storage guide 820.

Figure 17:
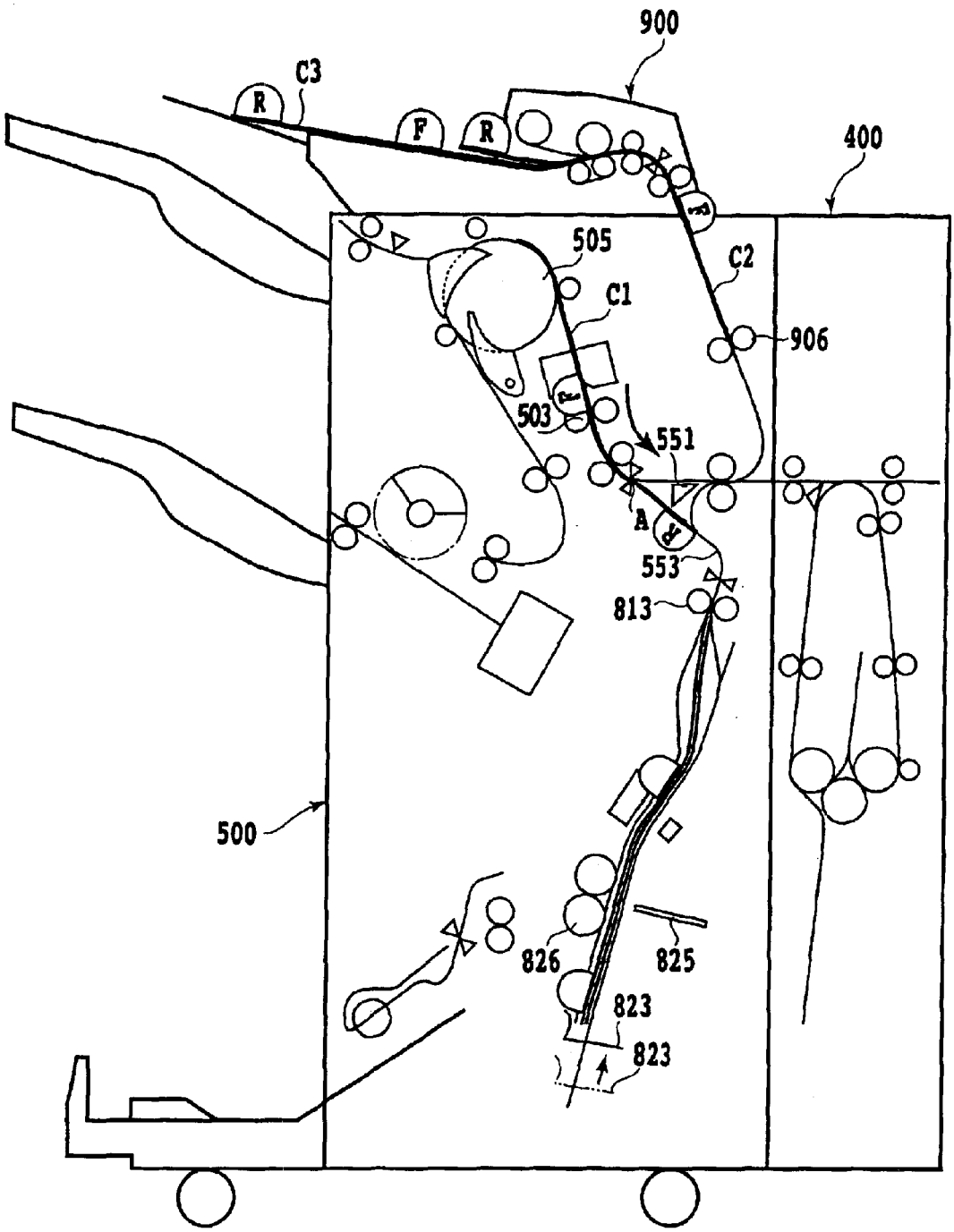
FIG. 17 is the fifth schematic diagram for illustrating the procedure for transporting the sheets to the storage guide of the finisher from the main unit of the image forming apparatus and the inserter.
Figure 18:
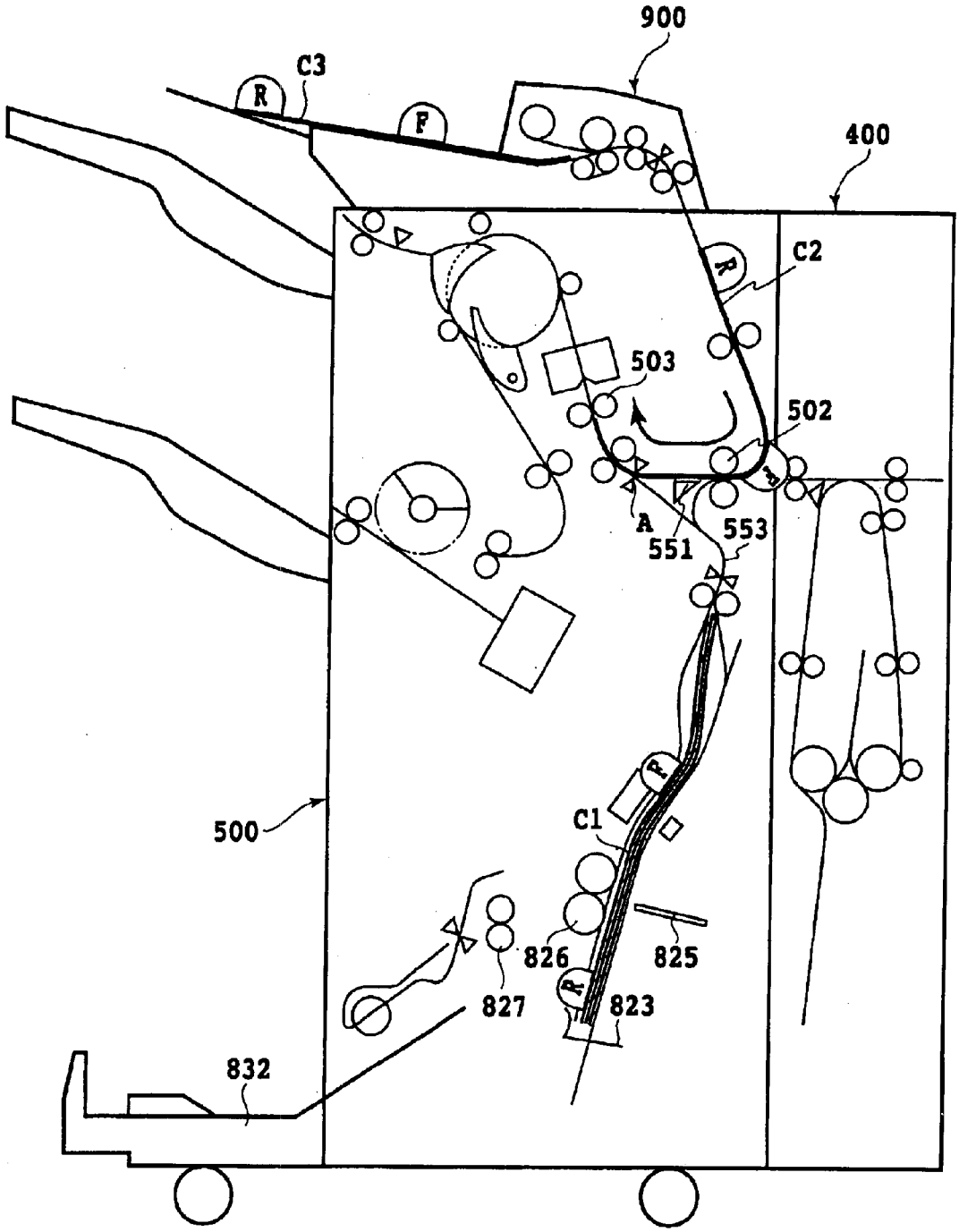
FIG. 18 is the sixth schematic diagram for illustrating the procedure for transporting the insert sheets to the storage guide of the finisher from the main unit of the image forming apparatus and the inserter.
Figure 19:
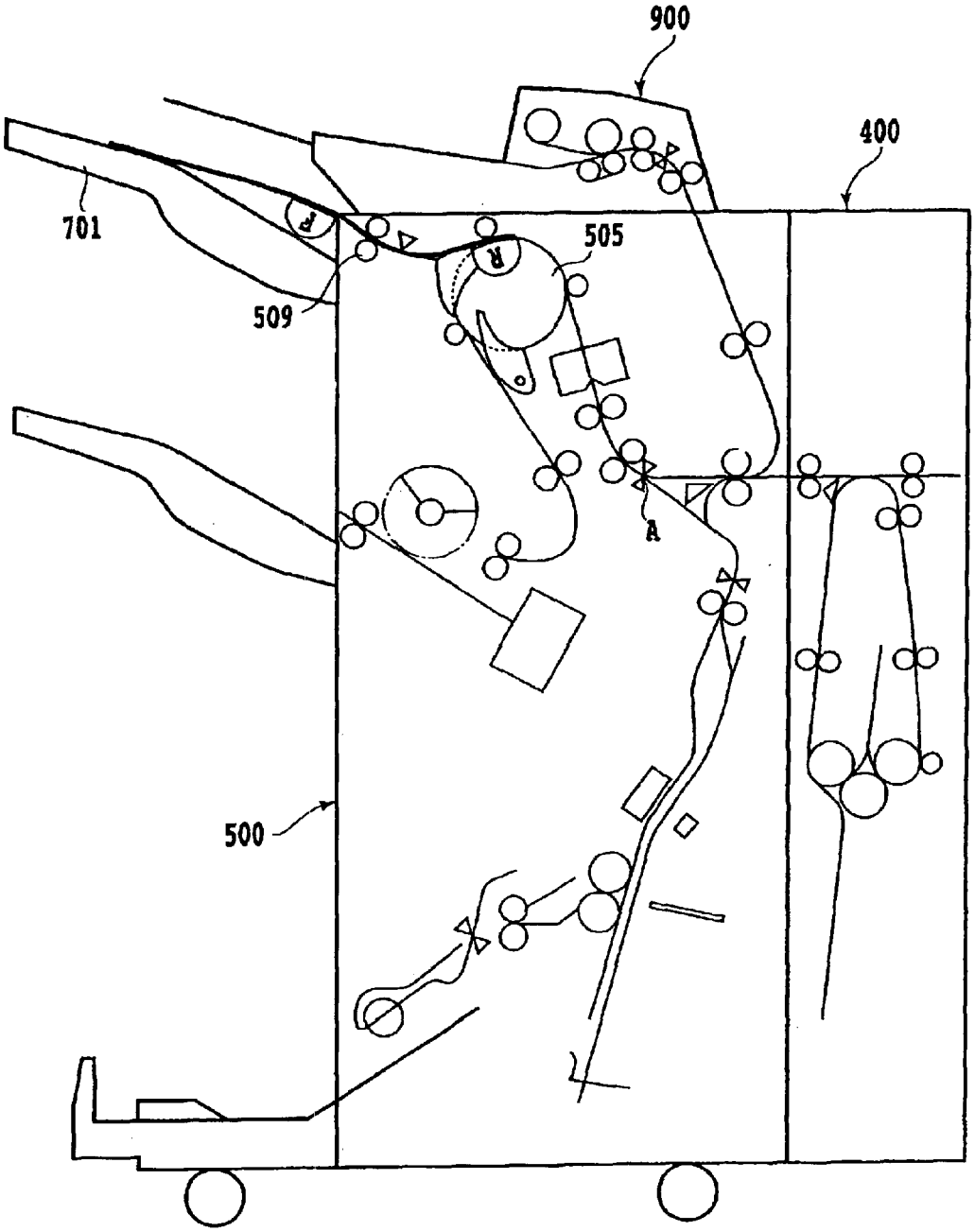
FIG. 19 is the seventh schematic diagram for illustrating the procedure for transporting the insert sheets to the storage guide of the finisher from the main unit of the image forming apparatus and the inserter.

When the predetermined number of sheet P are stored in the storage guide 820, as shown in FIG. 17, the sheet C1 is transported in reverse direction and guided into the storage guide 820 by way of the diverging point A and the second binding pass 554. In this case, the sheet C1 is, as shown in FIG. 18, transported from the side of the image R and is stored by being placed on the bundle of the sheets P1, P2, which have already been stored in the storage guide 820. When the sheet C1 is stored in the storage guide 820, the feed of the following sheet C2 is started. Similarly to the sheet C1, the sheet C2 is also guided to the side of the non-sort pass 521 and stops once. At this stage, when the sheet C2 is found not conforming to the predetermined size, the sheet C2 is discharged into the sample tray 701 without being stopped once in the state as is indicated in FIG. 16.

After the sheet C1 is stored in the storage guide 820 by being placed on the bundle of the sheet P1, P2, the thrusting member 825 is projected to the sheet C1 and the bundle of the sheets P1, P2 so that the bundle of the sheets is pushed out towards the pair of folding rollers 826. The bundle of the sheets is folded at the center thereof (corresponding to the boundary between the images formed thereon) by means of the pair of folding rollers 826 and is discharged into the saddle discharge tray 832. In such a folded state, as shown in FIG. 20B, the image F on the sheet C1 is formed on the front cover while the image R is formed on the last page. The images on the sheets P1, P2 are formed on the pages arranged sequentially and the directions of the images on the sheet C1 and on the sheet P1, P2 coincide with on another.

As described previously, the feed of the sheet C1 from the inserter 900 and the transport of the sheet P1, P2 from the printer 300 can be controlled respectively so that, in the bookbinding mode, not only the image F on the sheet C1 is made to appear on the cover and the image R on the sheet C1 is made to appear on the last page while the images on the sheets P1, P2 are made to appear in the order of the page numbers but also the directions of the images can be made to coincide with one another. Thus, the sheets and the special sheets can be combined in the process of bookbinding without spoiling the quality of the print on the special sheets supplied from the inserter 900 and without adversely affecting the sheet transport durability of the printer 300. Furthermore, during the sort mode, the special sheet to be inserted can be kept waiting in the non-sort pass 521 by means of the finisher 500 and then the sheets from the printer can be guided to be stored in the storage guide 820 and then, the special sheet, which has been kept waiting in the non-sort pass 521, is guided into the storage guide 820 for being stored. Therefore, the productivity of binding operation including the process for combining the sheet and the special sheet can be improved.

Further, when necessary, the sheet C1 overlapped with the bundle of the sheet P1, P2 in the storage guide 820 can be bound at the center thereof with the stapler.

(Description of Operation by Flowchart)

The insert processing in the sheet insertion mode as an embodiment of the present invention will be described referring to the Flowchart of FIG. 21.

Figure 23:
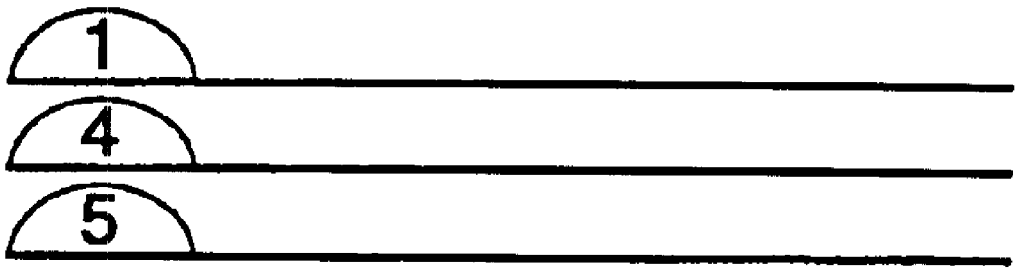
FIG. 23 is a schematic diagram illustrating the originals loaded on the original feeding device in the sheet insertion mode.
Figure 24:
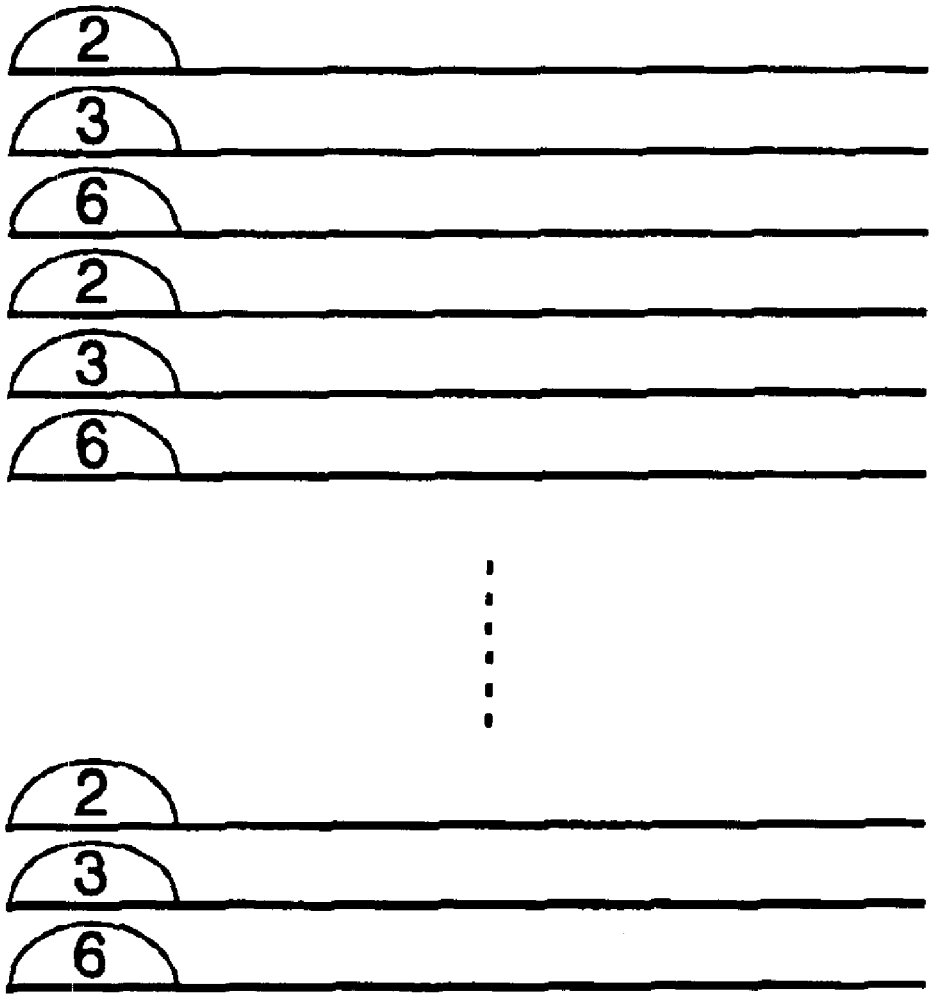
FIG. 24 is a schematic diagram illustrating the insert sheets loaded on the inserters in the sheet insertion mode.

A bundle of sheets can be prepared by means of the inserter 900. For example, the inserter 900 can be used in preparing a bundle of sheets consisting of 6 sheets, of which the second, the third and the sixth sheets as being the special sheets are fed from the inserter 900, and the images on the first, the fourth and the fifth sheets are formed by the image forming apparatus 10. In the following description, the bundle of sheets is assumed to consist of six sheets. In feeding the special sheets from the inserter 900, the place for inserting the special sheet among the bundle of the sheets can be set by the operating section 153 of the image forming apparatus 10, and any desired number of sheets can be inserted. Further, in preparing several bundles of the sheets, the sheets to constitute bundles are set bundle by bundle on the tray 901 in the order of feeding from the inserter 900. In other words, in the case the above example, the insert sheets are set sequentially as the second, the third and the sixth sheets of the first bundle and as the second, the third and the sixth sheets of the second bundle and so on. In this case, as shown in FIG. 23, the first, the fourth and the fifth sheets are loaded on the original tray of the original feeding device 100. Further, as shown in FIG. 24, the number of sheets corresponding to registered or prepared number, i.e., a set of 3 sheets, namely, the second, the third and the sixth sheets, are stacked on the inserter 900.

The sequence for feeding the sheets is specified by means of the control section 153 of the image forming apparatus 10 before turning on the copy start key (S151). Depending on the bundle of the sheets to be prepared, the timing at which the feed of the sheet whereon the image has been formed by the image forming apparatus 10 is to be started and the timing at which the insert sheets are to be fed from the inserter 900 are adjusted by the image forming apparatus 10 (S152).

The image forming apparatus 10 determines whether the first sheet is one supplied from the inserter or not (S153). For example, in the above-mentioned case, the first sheet is supplied from the image forming apparatus 10 (S154). At S154, the sheet for recording, which has been kept waiting after having been previously transported to the resist roller 126 from the cassettes 114 and 115, is transported to the transcribing device 116.

Further, for the timing (the second sheet in the above example) by which the sheet is to be fed from the inserter, which is the second sheet feeding device, the command requiring the feed of the insert sheet from the inserter 900 is issued to the finisher 500. When the insert sheet is supplied from the inserter 900 (S155), whether the overlapped sheets have been supplied or not is determined by the overlapped supply detection sensor 950, as being a overlapped transport detection device. (S156)

Here, how to determine the overlapped transport will be discussed briefly. In determining the occurrence of the overlapped transport in the case of the sheet insertion mode, the thickness (dn) of the sheet to be inserted is measured by the overlapped transport detecting sensor 950 when preparing the first bundle of the sheets, and the thickness of each sheet (d1, d2, . . . , dn; 1 through n are page numbers) is stored in the RAM513. The data of the sheet thickness is used as the source of the reference values in determining the overlapped transport of the sheet for the subsequently prepared bundle of the sheet. Then, when preparing the bundles of sheets from the second bundle on, the thickness (Xn) of each of the insert sheets is measured at the time of the passage of the overlapped transport sensor so that the measured data concerning the thickness of the sheet for n-page can be compared with the data dn concerning the thickness of the sheet stored in the RAM513. The determining processing the overlapped transport is processed by the CPU provided on the side of the finisher.

When it is found that there has been no overlapped transport (S157), the sheets are transported to the processing tray 630 (S158). The image forming apparatus 10 examine whether or not the sheet concerned is the last sheet of the bundle (S159). When it is found that the sheet concerned is not the last sheet, the step of the processing is put back to the step S152 for controlling the next sheet.

When the sheet is found to be the last sheet of the bundle at the step S159, the bundle of the sheets is discharged onto the stack tray 700 from the stack tray 630 (S160). In this stage, the bundle of the sheets discharged onto the processing tray 630 can be bound by means of the stapler 818.

At step S161, it is examined whether the discharge of the last bundle is finished or not. If not finished, the processing goes back to S152; if discharge of the last bundle is finished, the processing comes to an end.

Next, the processing to be made in step S157 in the case where the overlapped transport of the insert sheets is detected will be described. At step S162, the number of overlapped sheets is determined. Here, the procedure for determining the number of overlapped sheets will be described briefly.

In the above example, the number of insert sheets is 3 sheets, namely, the sheets for the second, the third and the sixth pages, and it is assumed that the sheet for the second page is transported overlapping with the sheet for other page. In this case, where the thickness X2 of the second page satisfies $$d2+\beta 3d3<X2<d2+d3+\beta d6,$$

it can be concluded that the 2 sheets, i.e., the second page and the third page, were overlapped when transported, where it is assumed that $\beta=0.5$. In general, where a set of insert sheets loaded on the inserter consists of n sheets, in determining whether the overlapped number of sheets occurring when m-th sheet is to be transported is t or not, it can be determined by $$dm+d(m+1)+\ldots+\beta d(m+t-1)<Xm<dm+d(m+1)+\ldots+\beta d(m+t).$$

In this way, the transported number of overlapped sheets can be determined by using the reference values of the sheet thickness stored in the RAM 513.

When it is detected that the two sheets, i.e., the second page and the third page, have been transported in overlapped condition as the result of the determination of the transported number of overlapped sheets, the sheets transported in overlapped condition are discharged onto the processing tray 630 (S163). Further, it should be noted that this processing is executed on the side of the finisher.

Next, the processing for the void transport of the insert sheet is executed (S164). Here, an explanation about the void transport will be made briefly.

Following the transport of the overlapped sheets for the second and third pages, the sheet for the sixth page, which is to be inserted into the same bundle of the sheets, is also discharged onto the processing tray 630. In other words, when the overlapped transport has occurred with respect to a sheet inserted among n-th bundle (including the case where the insert sheets have been transported overlapping with last sheet of (n−1)-th bundle), all of the insert sheets of n-th bundle are discharged onto the processing tray 630 to bring the first sheet among (n+1)-th bundle to the condition in which the feed of the sheet is possible. By carrying out such void transport processing, the sheet to be inserted as the first page of the next bundle can be selected. In other words, the first sheet of the next bundle or the next set of the insert sheets can be found.

The number of sheets for void transport is determined according to the procedure described below.

Where it is assumed that the number of insert sheets corresponding to one set of bundled sheets (record sheets and insert sheets) is X; and the insert sheet, which has been overlapped with other sheet when transported, is the Y-th sheet among one set of insert sheets; and the number of sheets transported in overlapped condition is Z, it follows that $$Y+(Z-1),$$

so that the number of sheets, which have been fed for insertion among the bundle of the insert sheets (one set of insert sheets to be inserted into one set of bundled sheets) at point in time when the overlapped transport has occurred, can be obtained.

When the sheet, which has been transported in overlapped condition, belongs to the same bundle of the insert sheets, that is, where $$Y+(Z-1)\leqq X,$$

It follows that the number of sheets of void transport X−(Y+(Z−1)).

Further, where the sheet, which have been transported in overlapped condition, is involved in the next bundle of sheets and the following bundles of sheets, that is, where $$Y+(Z-1)>X,$$

It follow that the number of sheets of void transport=X−{(Y+(Z−1))/remainder of X}.

During this process, the formation of the image on the record sheet is suspended.

Then, when the sheets transported in overlapped condition (S163) and the insert sheets transported in void condition (S164) are discharged onto the processing tray 630, the sheets whereon the images have been formed, the sheets transported in overlapped condition and the insert sheets, which are loaded on the processing tray 630, are discharged onto the stack tray 700 (S165). In this case, even when the post-processing mode, such as the stapling mode, has been selected, the post-processing is skipped for the discharge onto the stack tray 700.

Then, in order to start preparing a new bundle, the feed of insert sheet or the record sheet is started from the first page (S152). In the above case, since the first page is the sheet for recording, the formation of the image is resumed from that on the first page.

Figure 21:
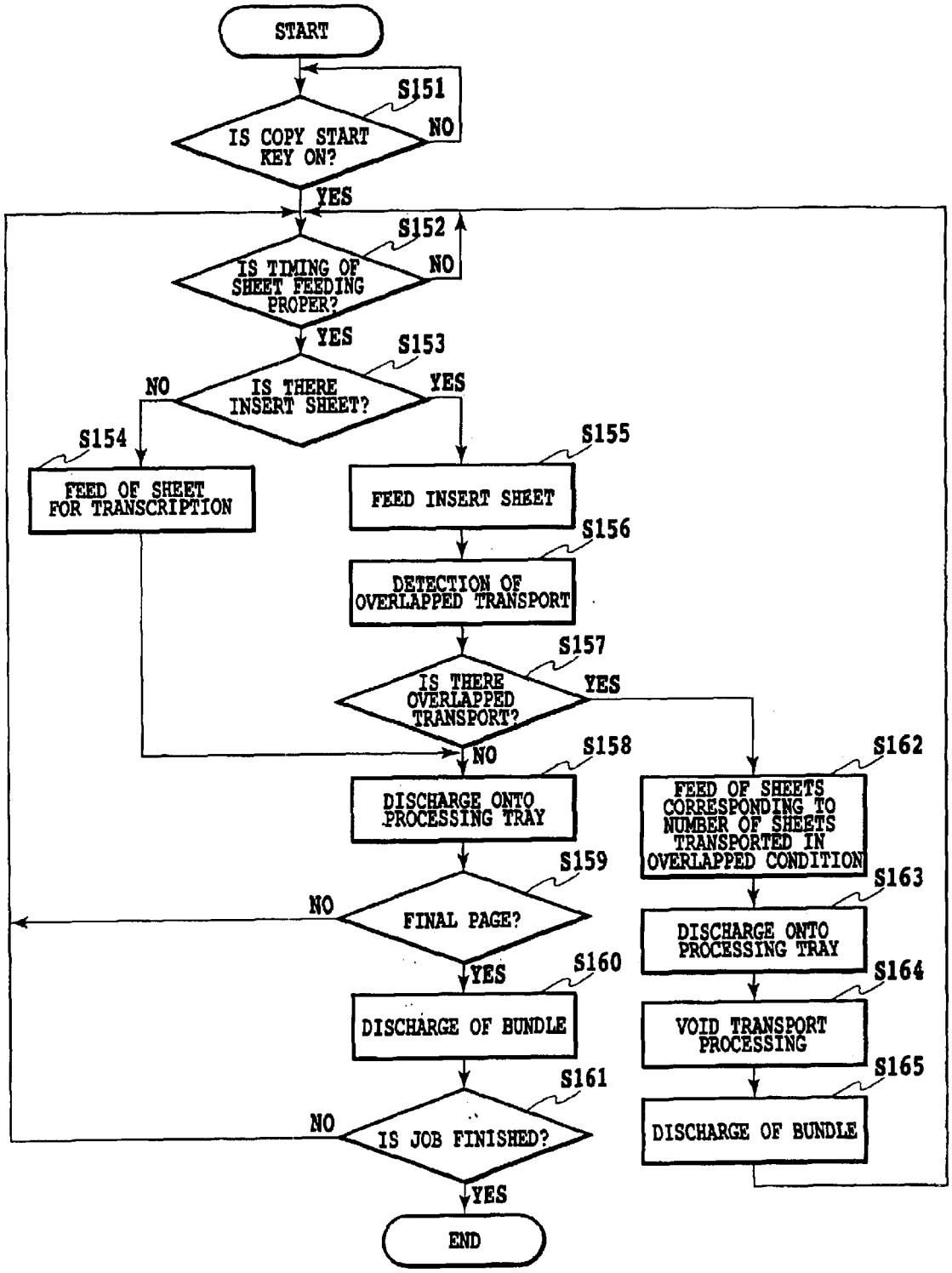
FIG. 21 is a flowchart for illustrating the sheet inserting process applied throughout the image forming system as an embodiment of the present invention.
Figure 22A:
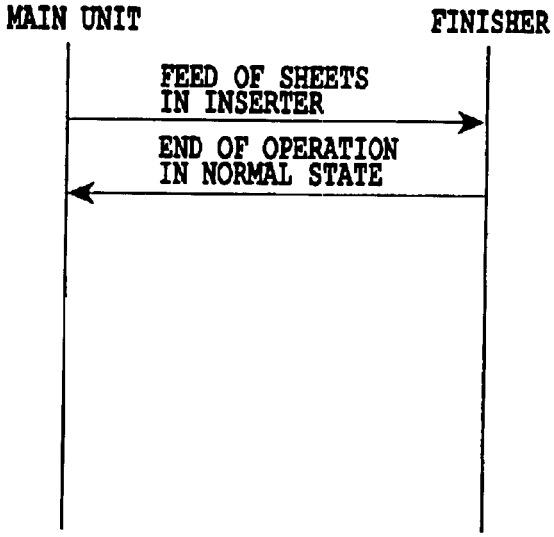
Figure 22B:
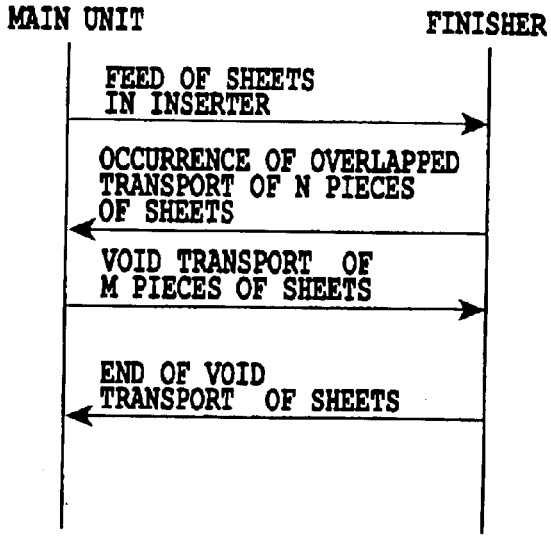
FIG. 22B is a schematic diagram illustrating the flow of the control signal between the main unit of the image forming apparatus and the finisher according to the present invention at the time when the overlapped transport has occurred.

What is described above is the flow of the processing in the whole system (including the main unit of the image forming apparatus and the finisher) as is illustrated in FIG. 21, and, further, in order to clarify the functions of the main unit of the image forming apparatus and the finisher, the flow of the control signal between the main unit of the image forming apparatus and the finisher is shown in FIGS. 22A and 22B.

FIG. 22A shows the flow of the control signal when the sheet feeding process by the inserter of the finisher is finished normally (without overlapped transport of the sheets), while FIG. 22B shows the flow of the control signal when the transport of the sheet in overlapped condition has occurred during the paper feeding process by the inserter.

When the command requiring the feed of the sheet by the inserter is outputted from the main unit of the image forming apparatus to the finisher, the finisher measures the thickness of the sheet to determine whether the sheets in overlapped condition have been transported or not. When it is found by the finisher that the feed of the sheet by the inserter has been finished normally, the signal for telling the normal completion of the feed of the sheet is outputted to the main unit from the finisher (FIG. 22A).

When the finisher has detected the transport of the sheets in overlapped condition, the finisher counts the number of sheets transported in overlapped condition on the basis of the data concerning the sheet thickness. Then, the occurrence the overlapped transport of sheets and the number of overlapped sheets is notified to the main unit from the finisher. In receipt of such notice, the commands for the void transport and the number of sheets for void transport are issued to the finisher from the main unit (FIG. 22B).

In the case of another embodiment wherein it is timed that the image is formed on the next record sheet during the feed of the insert sheet, if this method is applied to the above case, during the feed of the insert sheet as the second page, the record sheet, which has been kept waiting at the resist roller 126, is transported to the transcriber 116 to form the image on the record sheet for the fourth page. When the overlapping of the insert sheets corresponding to the second and the third pages has occurred at the timing of the transport thereof, the feed of the sheet from the resist roller 126 is prohibited at the point when the overlapped transport is detected, and the insert sheets transported in overlapped condition and the following record sheet corresponding to the fourth page are discharged onto the processing tray 630 for void transport processing. When the record sheet for the fourth page in transport is nipped between the resist rollers 126, the drive is stopped after the record sheet has passed through the resist rollers 126. In other words, the recording sheet, whose front end had passed the resist rollers 126 (or on the resist rollers) at the point when the overlapped transport occurred, is discharged.

Further, when recording sheets for the fifth page have already been supplied from the cassettes 114 and 115, this recording sheet will not be used as the recording sheet for the fifth page but will be used as the recording sheet for recording the image of the fist page after the recovery from the overlapped transport, and thus such recording sheet is transported to the resist rollers 126 to be kept waiting there.

Then, for the recording sheet which has been kept waiting at the resist rollers 126, the setting for having the image of the fifth page formed thereon will be cancelled, and the resetting will be made for having the image from the first page formed thereon.

Owing to the control system described in the foregoing, even if the overlapped transport has occurred with respect to the sheet for insertion, the condition for enabling the printing to be started from the front page of the next bundle can be recovered automatically.

As discussed in the foregoing, the system according to the present invention provides only one discharge tray and is designed so that appropriate recovery processing can be made automatically even if the transport of the sheets for insertion in overlapped condition has occurred, thereby liberating the user from the need of the recovery processing that requires the intervention by the user and providing the users with an image forming apparatus having improved utility.

Furthermore, (the image forming apparatus) according to the present invention enables the users to re-use the expensive sheets for insertion even after the overlapped transport has occurred.

The present invention has been described in detail with respect to preferred embodiments, and it will now be apparent from the foregoing to those skilled in the art that changes and modifications maybe made without departing from the invention in its broader aspect, and it is the intention, therefore, in the apparent claims to cover all such changes and modifications as fall within the true spirit of the invention.

What is claimed is:

1. An insert sheet transporting apparatus, comprising;

a feeding device for loading a plurality of sets of insert sheets and feeding the insert sheets one by one, a determining device for determining whether the insert sheets, which have been fed from said feeding device, have been transported in overlapped condition, and a controller for controlling said feeding device to continuously feed the rest of insert sheets of the set involved in the overlapped transport so as to feed the next set of insert sheets in a case where the overlapped transport is determined by said determining device.

2. An insert sheet transporting apparatus as claimed in claim 1, wherein the determining device determines the number of the sheets transported in overlapped condition and the controller controls to feed the next set of the insert sheets on the basis of the number of sheets transported in overlapped condition which has been determined by the determining device.

3. An insert sheet transporting apparatus as claimed in claim 1, wherein the insert sheet transporting apparatus can be connected with an image forming apparatus for forming the image on the sheet and comprises a transmission device for transmitting the result of the determination by said determining device to said image forming apparatus.

4. An image forming apparatus, comprising:

a first feeding device for feeding the blank sheets for recording one by one, an image forming device for forming the image on the blank sheet for recording, a transport device for transporting the blank sheets for recording, which have been kept waiting after having been fed from said first feeding device, to said image forming device at predetermined timing, a second feeding device for loading a plurality of sets of insert sheets and feeding the insert sheets one by one, a determining device for determining whether or not the insert sheets fed from said second feeding device have been transported in overlapped condition, and a controller for controlling said second feeding device to continuously feed the rest of insert sheets of the set involved in the overlapped transport so as to feed the next set of insert sheets, and to discontinue the drive of said transport device, in a case where the overlapped transport is determined by said determining device.

5. An image forming apparatus as claimed in claim 4, wherein, when the transporting of said blank sheets for recording to said image forming apparatus had already started at the point where the overlapped transport of said insert sheets was determined by said determining device, the controller controls to discontinue the drive of said transport device after the transporting has been completed.

6. An image forming apparatus as claimed in claim 4, wherein, when the overlapped transport of said insert sheets has been determined by said determining device, the controller controls to continuously feed the rest of insert sheets of the set involved in the overlapped transport and the blank sheets for recording on which the images have formed by said image forming apparatus, to resume the drive of said transport device and to start forming the images.

7. An insert sheet transporting method, comprising;

a feeding step for loading a plurality of sets of insert sheets and feeding the insert sheets one by one, a determining step for determining whether or not the insert sheets fed in said feeding step have been transported in overlapped condition, and a control step for controlling to continuously feed the rest of insert sheets of the set involved in the overlapped transport so as to feed the next set of insert sheets in a case where the overlapped transport of the insert sheets is determined in said determining step.

* * * * *

UNITED STATES PATENT AND TRADEMARK OFFICE

CERTIFICATE OF CORRECTION

PATENT NO. : 6,904,261 B2
DATED : June 7, 2005
INVENTOR(S) : Takayuki Fujii et al.

It is certified that error appears in the above-identified patent and that said Letters Patent is hereby corrected as shown below:

Title page, Item [54] and Column 1, line 2,
Title, the first occurrence of "APPARATUS" should read -- APPARATUS, --.

Column 1,
Line 23, "of" should read -- or --.
Line 35, "sheet" should read -- sheets --.
Line 59, "as" should be deleted and "spread" should read -- spreading --.

Column 2,
Line 26, "tend" should read -- tends --.

Column 4,
Line 57, "diagram" should read -- diagrams --.
Line 60, "the" should read -- and the --.

Column 9,
Line 26, "end" should read -- end of --.
Line 52, "detect" should read -- detects --.

Column 10,
Line 2, "that" should read -- those --.
Line 11, "erating" should read -- erate --.

Column 13,
Line 6, the second occurrence of "the" should be deleted.

Column 14,
Line 48, the second occurrence of "the" should be deleted.

Column 15,
Line 37, "sheet P" should read -- sheets P --.
Line 65, the second occurrence of "on" should read -- one --.

Column 16,
Line 43, "case" should read -- case of --.

Column 17,
Line 34, "examine" should read -- examines --.
Line 62, "$d2+\beta 3d3<X2<d2+d3+\beta d6$" should read -- $d2+\beta d3<X2<d2+d3+\beta d6$ --.

UNITED STATES PATENT AND TRADEMARK OFFICE

CERTIFICATE OF CORRECTION

PATENT NO. : 6,904,261 B2
DATED : June 7, 2005
INVENTOR(S) : Takayuki Fujii et al.

It is certified that error appears in the above-identified patent and that said Letters Patent is hereby corrected as shown below:

Column 18,
Line 58, “have” should read -- has --.
Line 64, “follow” should read -- follows --.

Column 19,
Line 42, “rence” should read -- rence of --.

Column 20,
Line 32, “maybe” should read -- may be --.

Signed and Sealed this

Eighteenth Day of October, 2005

JON W. DUDAS
*Director of the United States Patent and Trademark Office*